US009359159B2

(12) United States Patent
Noda et al.

(10) Patent No.: US 9,359,159 B2
(45) Date of Patent: Jun. 7, 2016

(54) SHEET FEEDING APPARATUS AND IMAGE FORMING APPARATUS

(71) Applicant: CANON KABUSHIKI KAISHA, Tokyo (JP)

(72) Inventors: Shinya Noda, Mishima (JP); Takashi Yano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/624,858

(22) Filed: Feb. 18, 2015

(65) Prior Publication Data

US 2015/0239695 A1 Aug. 27, 2015

(30) Foreign Application Priority Data

Feb. 26, 2014 (JP) ..... 2014-035789
Feb. 26, 2014 (JP) ..... 2014-035790

(51) Int. Cl.

| | |
|---|---|
| ***B65H 5/00*** | (2006.01) |
| ***B65H 7/14*** | (2006.01) |
| ***B65H 3/52*** | (2006.01) |
| ***B65H 5/06*** | (2006.01) |
| ***B65H 7/06*** | (2006.01) |
| ***B65H 7/12*** | (2006.01) |

(52) U.S. Cl.

CPC ..... *B65H 7/14* (2013.01); *B65H 3/5261* (2013.01); *B65H 5/062* (2013.01); *B65H 7/06* (2013.01); *B65H 7/12* (2013.01); *B65H 2404/6111* (2013.01); *B65H 2511/11* (2013.01); *B65H 2511/22* (2013.01); *B65H 2511/33* (2013.01); *B65H 2511/524* (2013.01); *B65H 2513/50* (2013.01); *B65H 2553/44* (2013.01)

(58) Field of Classification Search

CPC ..... G06K 15/4025; B65H 3/06; B65H 5/06; B65H 5/062; B65H 7/00; B65H 7/02; B65H 7/14; B65H 7/18; B65H 7/20; B65H 7/06; B65H 7/12; B65H 2513/40; B65H 2513/50; B65H 2511/22; B65H 2511/33; B65H 2511/11; B65H 2511/524

See application file for complete search history.

(56) References Cited

U.S. PATENT DOCUMENTS

| | | | | |
|---|---|---|---|---|
| 6,076,821 | A * | 6/2000 | Embry | B65H 7/18 271/10.01 |
| 6,260,840 | B1 | 7/2001 | Suga et al. | |
| 6,382,622 | B1 | 5/2002 | Takada et al. | |
| 6,467,767 | B2 | 10/2002 | Yano | |
| 6,988,727 | B2 | 1/2006 | Yano | |

(Continued)

FOREIGN PATENT DOCUMENTS

| | | | |
|---|---|---|---|
| JP | 07-121079 | A | 5/1995 |
| JP | 2004-317865 | A | 11/2004 |
| JP | 2007-169044 | A | 7/2007 |

*Primary Examiner* — Prasad Gokhale

(74) *Attorney, Agent, or Firm* — Fitzpatrick, Cella, Harper & Scinto

(57) ABSTRACT

A sheet feeding apparatus includes a stacking portion, a feed portion, a moving amount detecting portion provided downstream of the feed portion and configured to detect a moving amount of the sheet, and a control portion. The control portion is configured to change a timing for starting a sheet feed operation by the feed portion in feeding a n+1th sheet by the feed portion based on a detection result of the moving amount detecting portion detected when a nth sheet has been fed by the feed portion in feeding the sheets consecutively by the feed portion.

27 Claims, 29 Drawing Sheets

(56) References Cited

U.S. PATENT DOCUMENTS

| | | | | |
|---|---|---|---|---|
| 8,215,637 | B2 | 7/2012 | Yano | |
| 8,317,193 | B2 | 11/2012 | Yano | |
| 8,342,509 | B2 | 1/2013 | Takiguchi et al. | |
| 8,511,671 | B2 | 8/2013 | Takiguchi et al. | |
| 2004/0089996 | A1* | 5/2004 | Asada | B65H 7/18 271/110 |
| 2004/0245701 | A1* | 12/2004 | Rhoads | B65H 3/0669 271/110 |
| 2008/0237969 | A1* | 10/2008 | Totsuka | B65H 3/06 271/109 |
| 2012/0314267 | A1* | 12/2012 | Suzuki | G03G 15/607 358/498 |
| 2014/0159299 | A1 | 6/2014 | Yano | |
| 2014/0312562 | A1* | 10/2014 | Ueda | B65H 7/02 271/265.02 |

* cited by examiner

FRONT END OF SHEET ARRIVES AT FIRST DOUBLE-FEEDING DETECTING SENSOR
REAR END OF SHEET PASSES THROUGH FIRST DOUBLE-FEEDING DETECTING SENSOR
REAR END OF SHEET PASSES THROUGH NIP OF SEPARATING ROLLER
DOUBLE-FEEDING DETERMINATION TIMING AT FIRST DOUBLE-FEEDING DETECTING SENSOR
OUTPUT MONITORING RANGE

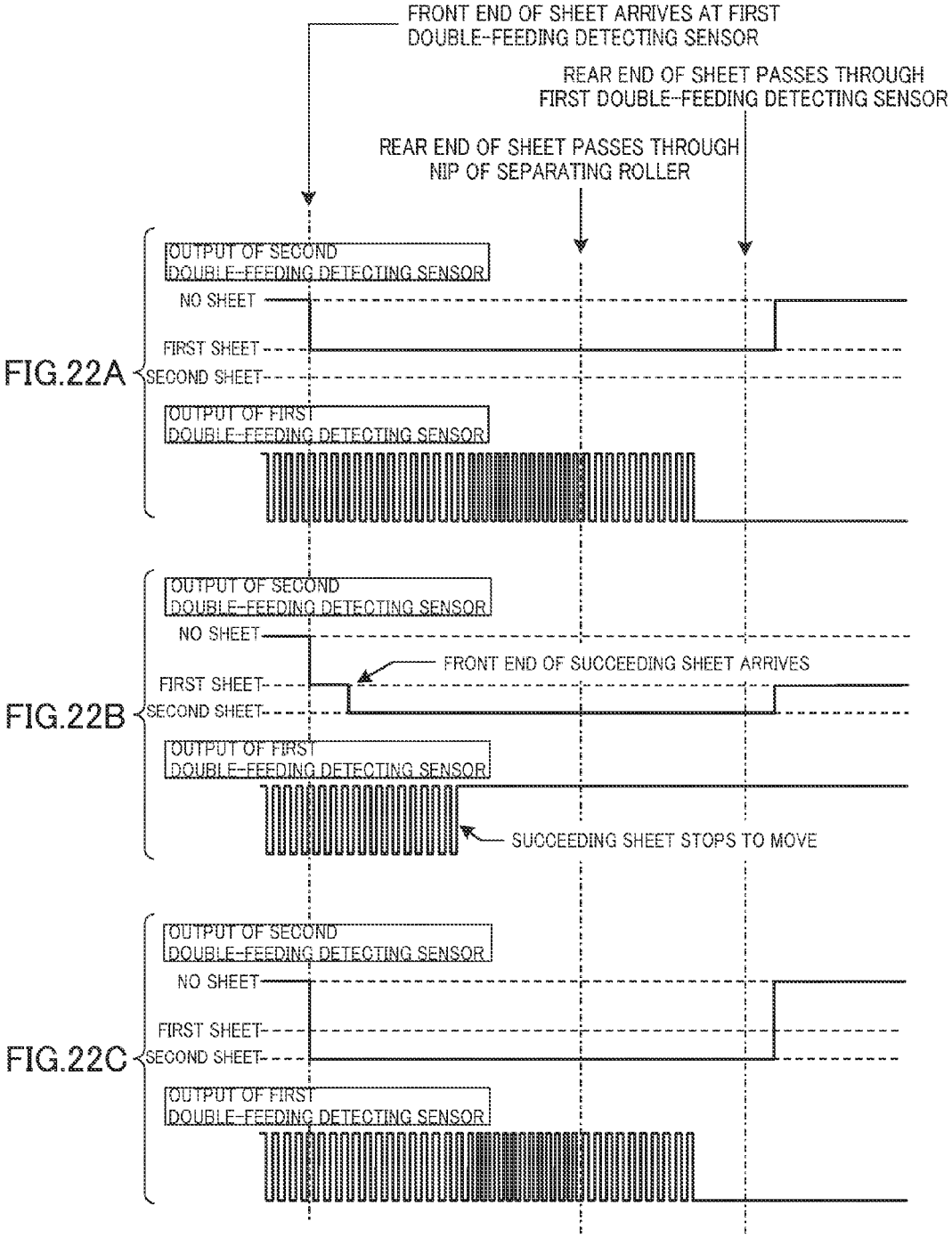
FRONT END OF SHEET ARRIVES AT FIRST DOUBLE-FEEDING DETECTING SENSOR
REAR END OF SHEET PASSES THROUGH FIRST DOUBLE-FEEDING DETECTING SENSOR
REAR END OF SHEET PASSES THROUGH NIP OF SEPARATING ROLLER
FIG.22A
OUTPUT OF SECOND DOUBLE-FEEDING DETECTING SENSOR
NO SHEET
FIRST SHEET
SECOND SHEET
OUTPUT OF FIRST DOUBLE-FEEDING DETECTING SENSOR
FIG.22B
OUTPUT OF SECOND DOUBLE-FEEDING DETECTING SENSOR
NO SHEET
FRONT END OF SUCCEEDING SHEET ARRIVES
FIRST SHEET
SECOND SHEET
OUTPUT OF FIRST DOUBLE-FEEDING DETECTING SENSOR
SUCCEEDING SHEET STOPS TO MOVE
FIG.22C
OUTPUT OF SECOND DOUBLE-FEEDING DETECTING SENSOR
NO SHEET
FIRST SHEET
SECOND SHEET
OUTPUT OF FIRST DOUBLE-FEEDING DETECTING SENSOR

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more specifically to control on timing for starting to feed a sheet.

2. Description of the Related Art

Hitherto, an image forming apparatus such as a printer, a copier, a facsimile or the like is configured to deliver an uppermost sheet within a bundle of sheets stacked in a sheet feed cassette one by one and then to convey the sheet by a sheet feeding apparatus so that the sheet arrives at an image forming portion at a predetermined timing. Here, the image forming portion is configured to form an image on an image carrier by receiving a signal from a control portion. Then, the image on the image carrier is synchronized with the sheet conveying timing to transfer the image to a predetermined position on the sheet. The image is fixed on the sheet under heat and pressure applied in a fixing portion, and the sheet is discharged by a discharging portion to a sheet discharge portion. In a case when such image forming operation is conducted consecutively, the sheets are conveyed at predetermined intervals (inter-sheet intervals) and the image forming portion also forms images at the same intervals to print consecutively.

Here, a conventional sheet feeding apparatus is provided with conveyance sensors detecting the conveyance of the sheet at main parts of a sheet conveying path. Then, a control is made such that such conveying operation is normally conducted by detecting a conveyance state of the sheet by detecting an arrival timing of an downstream side in a sheet conveying direction (front end) of the sheet and a passage timing of a upstream side in the sheet conveying direction (rear end) of the sheet by the conveyance sensors.

As such a conveyance sensor, there is known one including a sensor flag that swings by being in contact with the sheet and a photo sensor for example. This conveyance sensor is configured to output a signal indicating an arrival of the sheet to a control portion such that the sensor flag swung by the sheet being conveyed blocks an optical path of the photo sensor. It is noted that because the sensor flag continues to block the optical path of the photo sensor during when the sensor flag is swung by the sheet, a signal indicating that the sheet exists on the conveyance sensor is inputted to the control portion. When the sheet passes through the sensor flag, the conveyance sensor also outputs a signal indicating that the sheet has passed through because the sensor flag returns to its original position and the optical path of the photo sensor is opened. Thus, the conveyance sensor of this type detects whether or not the sheet exists on the sensor flag by the contact of the sensor flag with the sheet.

The conventional sheet feeding apparatus also includes a separating portion composed of a conveying roller formed of a high-friction member such as rubber and a separating member configured to bias the sheet from a back surface thereof to apply a conveyance load acting in a direction opposite from a sheet conveying direction. This configuration prevents double-feeding, i.e., a succeeding sheet from being delivered from the sheet feed cassette while partly overlapping with a preceding sheet, by arranging such that the sheet delivered from the sheet feed cassette passes through the separating portion. However, if an operation time becomes long, it becomes difficult to completely prevent the double-feeding due to a drop of a friction force of the separating member caused by its wear and adhesion of paper dust, to increase of a friction force between sheets, and others.

Then, the conventional sheet feeding apparatus is provided with a double-feeding detecting portion configured to detect double-feeding of sheets along a sheet conveying path. As such a double-feeding detecting portion, there is one configured to detect the double-feeding by judging whether one sheet or two or more sheets are passing from changes of transmittance by using a photo diode as disclosed in Japanese Patent Application Laid-open No. H07-121079. The sheet feeding apparatus using such double-feeding detecting portion is configured, when the double-feeding is detected, to measure a shift amount between a front end of a preceding sheet and a doubly fed sheet and to delay a next sheet feed operation by a time corresponding to the shift amount. Such control makes it possible to continue consecutive image forming operations in which a predetermined sheet interval is maintained even after detecting the double-feeding.

As another double-feeding detecting portion, there is one configured to detect whether no sheet, one sheet or two or more sheets are passing by utilizing such characteristics that frequency of ultrasonic attenuates when the ultrasonic transmits an object as disclosed in Japanese Patent Application Laid-open No. 2007-169044. The sheet feeding apparatus using such double-feeding detecting portion is configured to calculate a shift amount between a front end of a preceding sheet and a front end of a doubly-fed sheet by the ultrasonic and to adjust position of the doubly-fed sheet to toner image position on the image carrier by adjusting a sheet conveying speed. This configuration makes it possible to transfer the toner image on the image carrier to the predetermined position of the sheet even if the sheet is doubly fed. This configuration also makes it possible to continue the image forming operations successively after the double-feeding by maintaining the predetermined inter-sheet intervals by adjusting feed timing of the succeeding sheet.

By the way, even if the shift amount of the doubly-fed sheet is measured at the front end in the sheet conveying direction, there is a case when the shift amount of the doubly-fed sheet changes when the sheet is conveyed. Because the conventional double-feeding detecting portion is configured to detect changes of thickness of sheets, it is unable to judge whether the doubly-fed sheet is being conveyed or is stopped. Therefore, even if the shift amount of the doubly-fed sheet is measured, it is difficult to utilize the measured shift amount to such controls as changes of conveying speed and changes of feed timing of the succeeding sheet.

The doubly-fed sheet is stopped during its conveyance in the following cases. Normally, a conveying roller pair conveying a sheet is composed of a conveying roller formed of rubber or the like rotationally driven and exhibiting a high conveying force, and a driven roller formed of resin and elastically biased to the conveying roller. When doubly-fed sheets are conveyed, while a superordinate preceding sheet in contact with the conveying roller is conveyed downstream by receiving the high conveying force of the conveying roller, a subordinate succeeding sheet in contact with the driven roller is conveyed only by a friction force acting between the preceding sheet and the succeeding sheet.

Due to that, there is a case when a slip is generated between the succeeding sheet and the preceding sheet or the succeeding sheet stops if additional conveyance resistance is applied in passing through a curved sheet conveying path for example. If the succeeding sheet slips here, a shift amount at a rear end required to change a next feed operation increases more than the shift amount measured at the front end. Therefore, if the next feed operation is carried out based on the shift amount measured in terms of the front end, the next feed operation is started in a state in which there is no inter-sheet interval from the rear end of the previous doubly fed succeeding sheet.

In this case, because it is unable to detect a front end of a next sheet, it is unable to match the front end of the sheet with an image in the transfer portion. Still further, if the succeeding sheet stops, it becomes unable to continuously convey the stopped succeeding sheet because the conventional double-feeding sensor is unable to estimate a position where the succeeding sheet has stopped. Thus, the retention of the sheets must be treated as jamming.

Still further, the conventional double-feeding detecting portions detecting changes of thickness of the sheets by the transmittance and the attenuation of ultrasonic are required to adjust double-feeding detecting level corresponding to types of sheets such as thick and thin sheets. As a method for adjusting the detecting level, a user is required to adjust the detecting level by specifying the type of the sheet in starting to print. Then, a control portion judges whether a conveyance is a normal conveyance in which one sheet is conveyed or double-feeding in which two or more sheets are conveyed based on data stored in advance. As another method for adjusting the detecting level, the double-feeding detecting portion is reviewed by a sheet conveyed by a first feed operation after detecting opening/closure of the sheet feeding cassette. Then, based on reviewed information, the control portion discriminates whether a sheet conveyed from a second sheet or after is one sheet or double-feeding of two or more sheets.

However, in the former case, the user who is going to print does not always know the type of the sheet stacked in the sheet feeding cassette even if the type has been changed in a network printer. Therefore, there is a possibility that the user specifies a wrong sheet type and the double-feeding detecting portion judges as double-feeding and shifts to a double-feeding sequence even if the sheet is being normally conveyed. In the latter case, it is unable to discriminate whether the first sheet is being normally conveyed or doubly fed because the review is made by the value of the first time of the feed operation. Therefore, there is a problem that if the first sheet is doubly fed, it is unable to correctly detect double-feeding after that. Still further, it is unable to discriminate between the normal conveyance and the double-feeding because an output of the double-feeding detecting portion varies in conveying sheets in a case where a plurality of types of sheets is mixed. Therefore, in the case where the plurality of types of sheets is mixed, it is unable to convey the sheets consecutively without nullifying the double-feeding detecting portion.

SUMMARY OF THE INVENTION

A sheet feeding apparatus of the present invention includes a stacking portion configured to stack a sheet, a feed portion configured to feed the sheet stacked in the stacking portion, a moving amount detecting portion provided downstream of the feed portion and configured to detect a moving amount of the sheet in a feed direction in which the feed portion feeds the sheet, and a control portion. The control portion is configured to change a timing for starting a sheet feed operation by the feed portion in feeding a n+1th sheet by the feed portion based on a detection result of the moving amount detecting portion detected when a nth sheet has been fed by the feed portion in feeding the sheets consecutively by the feed portion.

Further features of the present invention will become apparent from the following description of exemplary embodiments with reference to the attached drawings.

BRIEF DESCRIPTION OF THE DRAWINGS

FIG. 22A illustrates output waveforms of the first and second double-feeding detecting sensors provided in the laser printer and shows a state in which one sheet is normally fed.

FIG. 22B illustrates output waveforms of the first and second double-feeding detecting sensors provided in the laser printer and shows a state in which an entrained succeeding sheet is stopped on its way.

FIG. 22C illustrates output waveforms of the first and second double-feeding detecting sensors provided in the laser printer and shows a case when two sheets are doubly fed without shifting from each other.

DESCRIPTION OF THE EMBODIMENTS

<First Embodiment>

Figure 1:
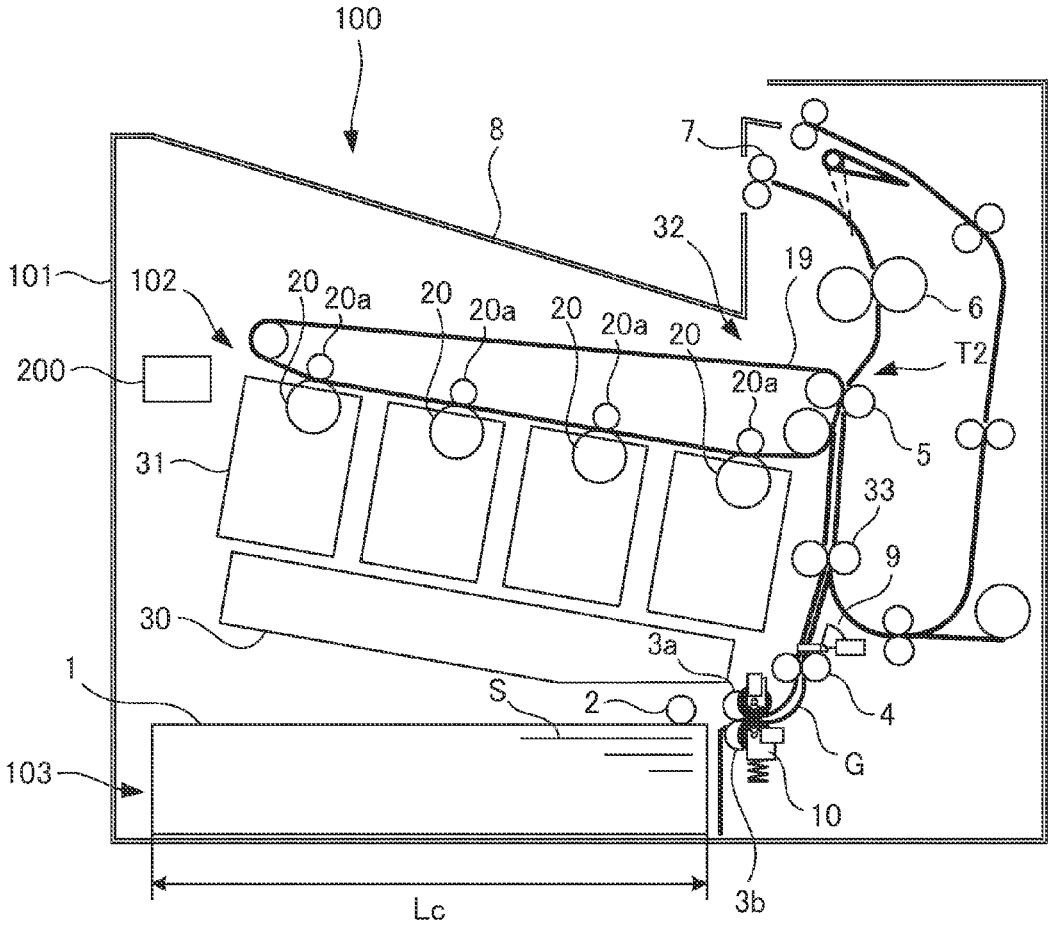
FIG. 1 is a schematic diagram showing a configuration of a laser printer, i.e., one exemplary image forming apparatus, including a sheet feeding apparatus of a first embodiment of the present invention.

A first embodiment of the present invention will be described below in detail with reference to the drawings. FIG. 1 illustrates a configuration of a laser printer 100, i.e., an exemplary image forming apparatus, including a sheet feeding apparatus of the first embodiment of the present invention. The laser printer 100 includes a body of the laser printer (referred to simply as 'printer body' hereinafter) 101, an image forming portion 102 configured to form an image on a sheet, a sheet feeding apparatus 103 provided at an under part of the printer body 101 and configured to feed a sheet S, and a control portion 200 configured to control an image forming operation, a sheet feed operation, and a sheet conveying operation.

The image forming portion 102 includes a scanner unit 30 and four process cartridges 31 configured to form four toner images of yellow (Y), magenta (M), cyan (C), and black (Bk). The image forming portion 102 further includes an intermediate transfer unit 32 disposed above the process cartridge 31 and including an intermediate transfer belt 19.

The intermediate transfer unit 32 also includes primary transfer rollers 20*a* provided in an inner side of the intermediate transfer belt 19 and in contact with the intermediate transfer belt 19 at positions facing to photosensitive drums 20. Then, the respective color toner images having a negative polarity on the photosensitive drum 20 are superimposed and transferred sequentially to the intermediate transfer belt 19 by positive transfer bias applied to the intermediate transfer belt 19 by the primary transfer rollers 20*a*. Thus, a full-color image is formed on the intermediate transfer belt 19.

The sheet feeding apparatus 103 includes a sheet feeding cassette 1, i.e., a stacking portion, configured to stack a sheet, and a feed roller 2, i.e., a sheet feeding portion, configured to feed an uppermost sheet of sheets stored in the sheet feeding cassette 1. Then, the uppermost sheet stacked on a middle plate within the sheet feeding cassette 1 is sequentially fed by the feed roller 2 intermittently driven. It is noted that the sheet S thus fed is conveyed by being separated one by one by passing through a separation nip composed of a conveying roller 3*a* and a separating roller 3*b* in contact with a back surface side of the sheet to apply friction that becomes a conveyance load.

Next, the image forming operation of the laser printer 100 constructed as described above will be described. In response to a start of the image forming operation, the scanner unit 30 irradiates laser light not shown to the photosensitive drum 20 based image information sent from a personal computer or the like not shown to sequentially expose a surface of the photosensitive drum 20 homogeneously electrified with predetermined polarity and potential and to form an electrostatic latent image on the photosensitive drum 20. After that, this electrostatic latent image is developed by toner as a visualized toner image. The visualized toner images are superimposed and transferred to the intermediate transfer belt 19 by primary transfer bias applied to the primary transfer rollers 20*a*. Thus, a full-color toner image is formed on the intermediate transfer belt 19.

Concurrently with this image forming operation, the uppermost sheet stored in the sheet feeding cassette 1 is delivered by the feed roller 2. This sheet S is conveyed by being separated one by one by passing through the separation nip between the conveying roller 3*a* and the separating roller 3*b*. Then, the sheet S passed through the separation nip is sent to a conveying roller pair 4, i.e., a conveying portion, while being bent substantially in a vertical direction along a bent conveyance guide G. The sheet S is then conveyed by the conveying roller pair 4 to a registration roller 33.

After correcting a skew of the sheet S by the registration roller 33, the sheet S is conveyed to a secondary transfer portion T2. In the secondary transfer portion T2, the full-color toner image is then collectively transferred to the sheet S by a secondary transfer bias applied to a secondary transfer roller 5. Next, the sheet S on which the full-color toner image has been transferred is conveyed to a fixing portion 6. In the fixing portion 6, the respective color toners melt and are mixed by receiving heat and pressure and are fixed on the sheet S as a full-color image. After that, the sheet S on which the image has been fixed is discharged to a discharge tray 8 by a discharge roller pair 7 provided downstream of the fixing portion 6.

Figure 2:
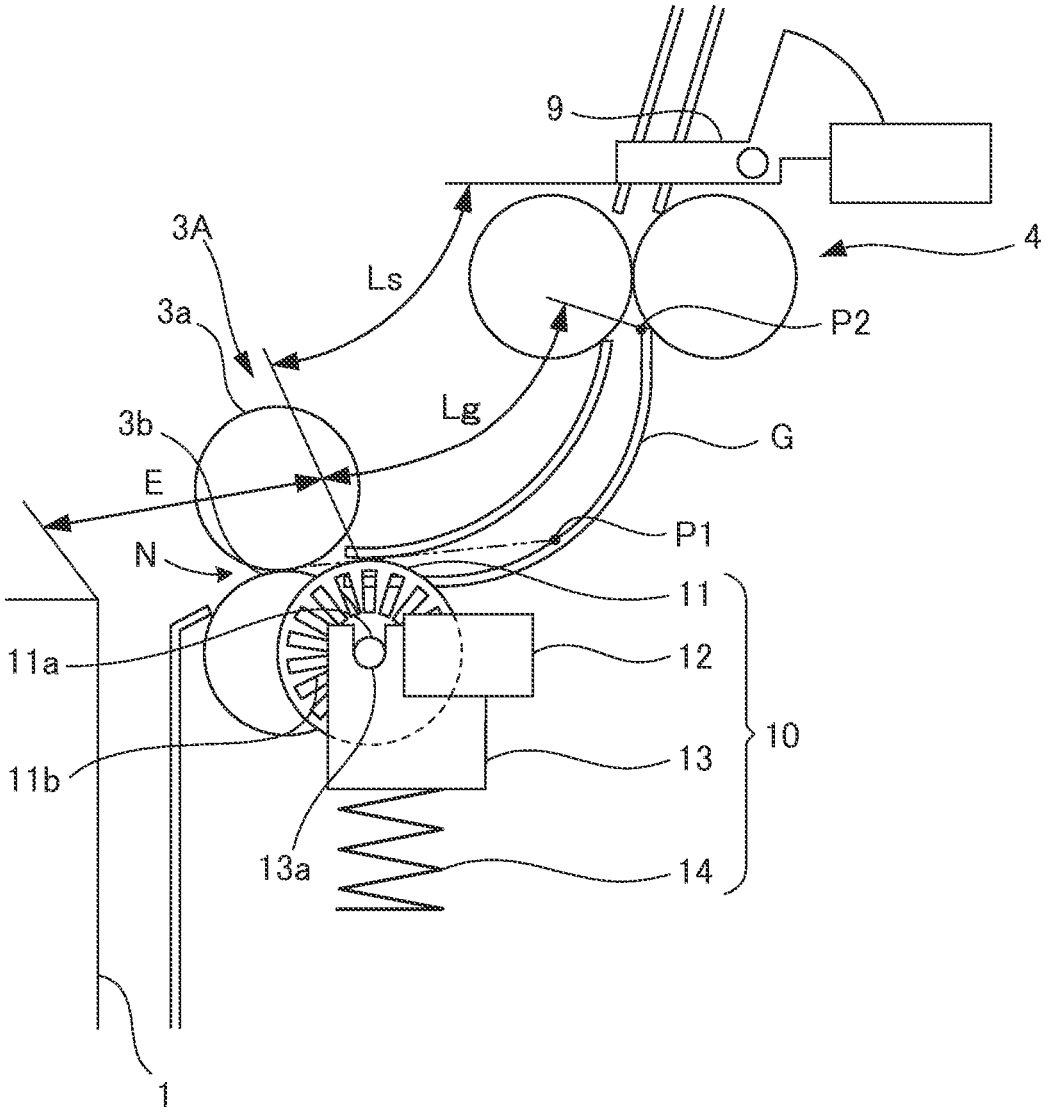
FIG. 2 is an enlarged view of a main part of the sheet feeding apparatus of the laser printer.

By the way, in the present embodiment, a moving amount detecting portion 10 is provided right after a separating nip portion N (in a vicinity downstream in a conveying direction)

between the conveying roller 3*a* and the separating roller 3*b* composing a separating portion 3A located downstream in a sheet feeding direction of the feed roller 2 as shown in FIG. 2. The moving amount detecting portion 10 is configured to be able to detect a moving amount of the sheet in the feeding direction. The moving amount detecting portion 10 is provided to estimate a position where a succeeding sheet delivered while overlapping partly or wholly with the preceding sheet stops. The moving amount detecting portion 10, i.e., an estimating portion, includes an encoder (rotating body) 11 coming in contact with the back surface of the sheet and rotated following to the sheet and a photo sensor (rotation amount detecting portion) 12 detecting a rotation amount of the encoder 11. The moving amount detecting portion 10 also includes a holder 13 rotatably supporting the encoder 11 and fixing the photo sensor 12 and a pressure spring 14 pressing the encoder 11 toward a direction of the sheet.

The encoder 11 includes a shaft portion 11*a*, i.e., a rotational shaft, and slits 11*b* formed in radial directions centering on the shaft portion 11*a*. The photo sensor 12 is fixed by the holder 13 at a position where an optical path thereof overlaps with the slits 11*b* of the encoder 11. The holder 13 includes a bearing portion 13*a* rotatably supporting the encoder 11 and a fixing portion not shown of the photo sensor 12 and bias the encoder 11 in the sheet direction by receiving the pressure of the pressure spring 14.

Figure 3:
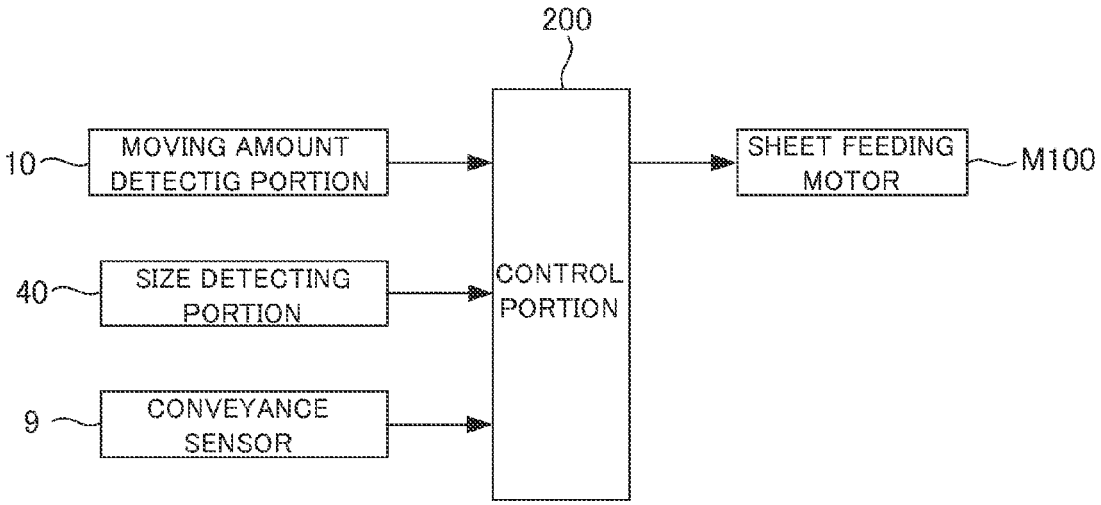
FIG. 3 is a control block diagram of the sheet feeding apparatus of the laser printer.

It is noted that the moving amount detecting portion 10 is connected to the control portion 200 as shown in FIG. 3 and the control portion 200 changes a timing for starting sheet feed operation by the feed roller 2 based on a signal from the moving amount detecting portion 10. Specifically, in a case of feeding sheets consecutively by the feed roller 2, the control portion 200 changes the timing of the sheet feed operation of an $n+1^{th}$ sheet based on a detection result of the moving amount detecting portion 10 detected when an $n^{th}$ sheet has been fed. It is noted that in FIG. 3, the control portion 200 is connected with also a size detecting portion (acquisition portion) 40, i.e., a length detecting portion, provided in the sheet feeding cassette 1 and detecting a length Lc in the sheet feeding direction of the sheet stored in the cassette, a conveyance sensor 9 disposed right after the conveying roller pair 4 (in a vicinity downstream in the sheet conveying direction) and detecting that the sheet S has arrived at the conveying roller pair 4, and a feed motor M100 driving the feed roller 2, the conveying roller 3*a* and the conveying roller pair 4. It is noted that while the size detecting portion 40 detects the length in the sheet feeding direction of the sheet in the present embodiment, the present invention is not limited to such configuration. For instance, the present invention may be configured such that information of the length is inputted from an operating portion provided in the body of the image forming apparatus or from a computer connected to the image forming apparatus.

In the present embodiment, the moving amount detecting portion 10 constructed as described above is disposed at the position right after the separating nip portion N and on a side in a direction of a rotational axis of the separating roller 3*b*. It is possible to detect a stoppage of a doubly fed sheet at early timing and to perform a recovery control of changing a next feed operation quickly by disposing the moving amount detecting portion at such position. Still further, because a posture of the sheet S is stabilized while being held at the nip portion N between the conveying roller 3*a* and the separating roller 3*b*, it is possible to stabilize the contact of the encoder 11 with the sheet by disposing the moving amount detecting portion 10 at such position. This arrangement allows the encoder 11 to output accurate output pulses corresponding to a move of the sheet.

Figure 4:
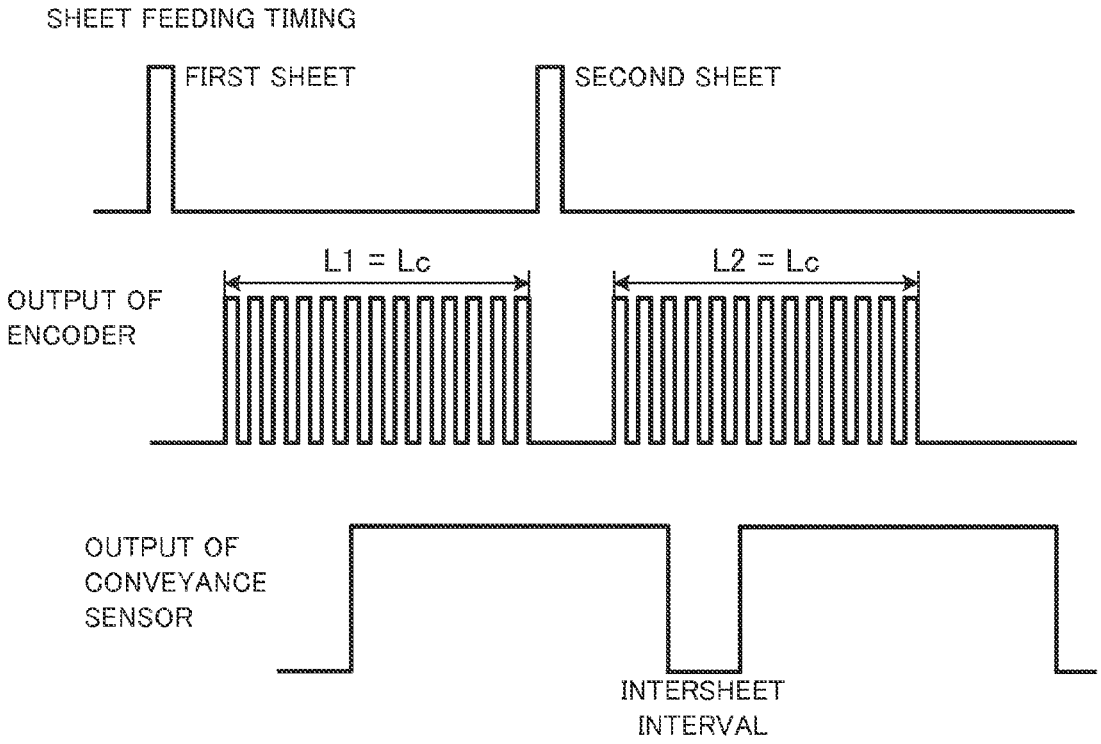
FIG. 4 illustrates output waveforms of a moving amount detecting portion and a conveyance sensor provided in the laser printer when sheets are normally conveyed.

By the way, output waveforms as shown in FIG. 4 can be obtained from the moving amount detecting portion 10 and the conveyance sensor 9 if the sheet is normally conveyed. Here, L1 in FIG. 4 indicates a moving distance of a first sheet (nth sheet) based on a number of pulses from the encoder 11 when the first sheet passes through after when sheets are consecutively conveyed. L2 indicates a moving distance of a second sheet (n+1th sheet) based on a number of pulses from the encoder 11 when the second sheet passes through.

When a front end of the first sheet arrives at the moving amount detecting portion 10, then the first sheet passes between the conveyance guide G and the encoder 11 shown in FIG. 2 described above. At this time, because the encoder 11 is biased in the sheet direction by the elastic force of the pressure spring 14, the encoder 11 rotates by friction between an outer circumference of the encoder 11 and the sheet without slipping. Then, when the encoder 11 rotates as described above, the photo sensor 12 repeatedly and consecutively receives light or is shaded by the slits 11*b* of the encoder 11 and generates the pulsed outputs as shown in FIG. 4.

Then, when the conveyance sensor 9 detects that the front end of the sheet arrives after being nipped by the conveying roller pair 4, the conveyance sensor 9 outputs a detection signal as shown in FIG. 4. The control portion 200 judges that the sheet has arrived at the conveyance sensor 9 by this signal. Still further, when a rear end of the sheet passes through the moving amount detecting portion 10, the rotation of the encoder 11 is stopped. Along with that, the output from the photo sensor 12 is stopped. That is, when the sheet passes through the moving amount detecting portion 10, the moving amount detecting portion 10 outputs a number of pulses corresponding to a moving distance of the sheet. This arrangement makes it possible to calculate the distance by which the sheet has moved through the moving amount detecting portion 10 by counting the number of pulses outputted from the moving amount detecting portion 10 when the sheet passes through the moving amount detecting portion 10.

The control portion 200 compares a length in a sheet feeding direction of the sheet (referred to as 'sheet length' hereinafter) Lc which is information on sheet length obtained from the size detecting portion 40 of the sheet feeding cassette 1 with a moving distance L1 which is a moving amount of the sheet obtained from the rotation of the encoder 11. Here, if the sheet length Lc coincides with the moving distance L1 within a range including a tolerance, i.e., L1−Lc, the control portion 200 judges that the sheet is normally delivered by the sheet feeding roller 2 from the sheet feeding cassette 1. Then, if the moving distance L1 detected by the moving amount detecting portion 10 coincides with the sheet length Lc within the range including a tolerance when the first sheet is fed, the control portion 200 starts the feed operation of the second sheet after an elapse of a predetermined time x from the start of the feed operation of the first sheet. It is noted that the discrimination whether or not the sheet is normally conveyed after that is made by measuring a time until when the sheet arrives at the conveyance sensor 9 from the start of the feed operation and a time until when the sheet passes through from the detection of the arrival of the sheet to the conveyance sensor 9. In a case of consecutive feeding, a number of pulses corresponding to a moving distance L2 of a sheet to be fed next is outputted while interposing an inter-sheet interval.

By the way, there is a case when a large amount of sheet dusts adheres to the separating roller 3*b* or a contact force of the separating roller 3*b* with the conveying roller 3*a* drops due to advance of wear of the separating roller 3*b* during a long-term use. In such a case, a friction force, i.e., a conveying load, drops, disabling to exhibit a desirable separating performance. If a plurality of sheets S is delivered from the feed roller 2 in this state, there is a possibility that the separating nip portion N composed of the conveying roller 3*a* and the separating roller 3*b* cannot generate an conveying load enough for blocking a subordinate sheet Sj and the subordinate sheet Sj is doubly fed downstream of the separating nip portion N.

Figure 5A:
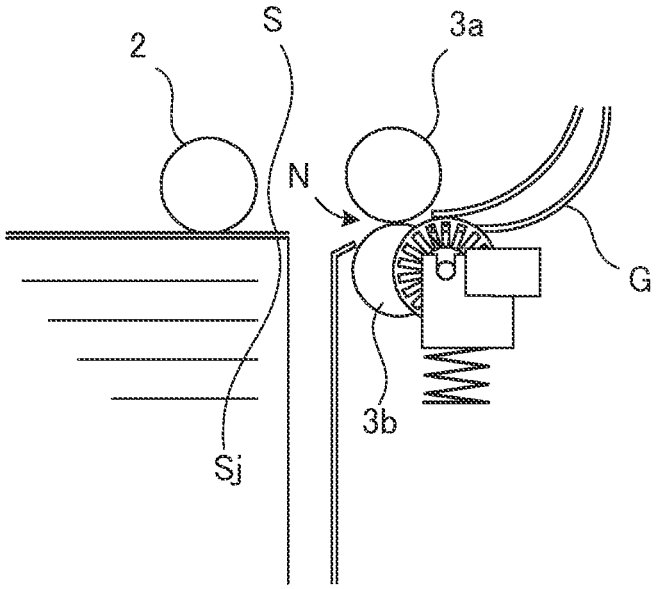
FIG. 5A is a diagram illustrating a first case (pattern) of double-feeding of sheets in the laser printer and showing a state before when the sheets are started to be fed.
Figure 5B:
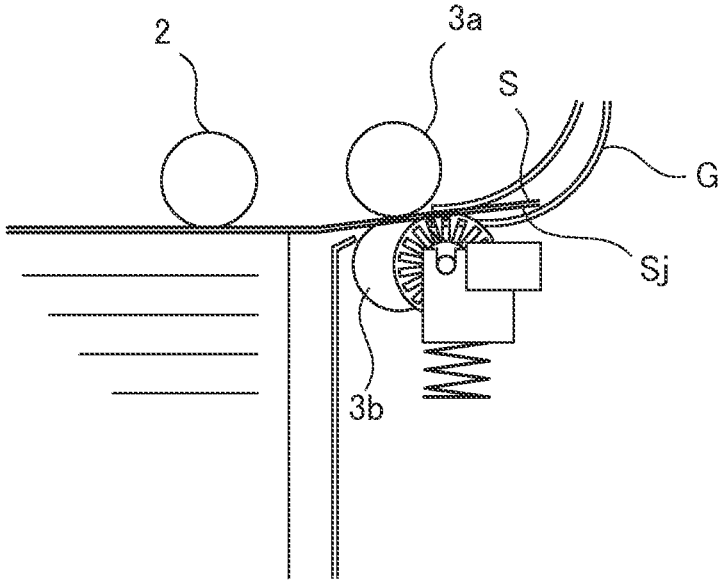
FIG. 5B is a diagram illustrating the first case of the double-feeding of sheets in the laser printer and showing a state after when the sheets are started to be fed.

Here, the following three cases are assumed to happen as the case when the subordinate sheet Sj is doubly fed. The first case is a case when the subordinate sheet Sj is doubly fed in a state in which front ends of an uppermost sheet S and of the second sheet Sj are aligned as shown in FIGS. 5A and 5B. That is, this is a case when the uppermost sheet S and the second sheet Sj are concurrently fed in the feed operation.

Figure 6A:
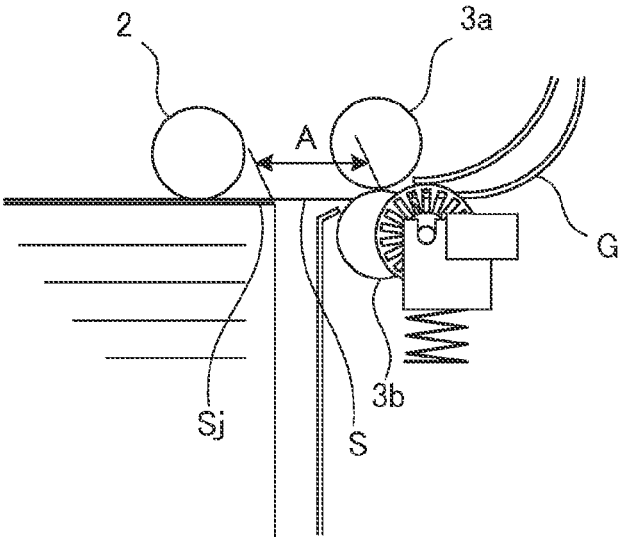
FIG. 6A is a diagram illustrating a second case (Pattern) of double-feeding of sheets in the laser printer and showing a state before when the sheets are started to be fed.
Figure 6B:
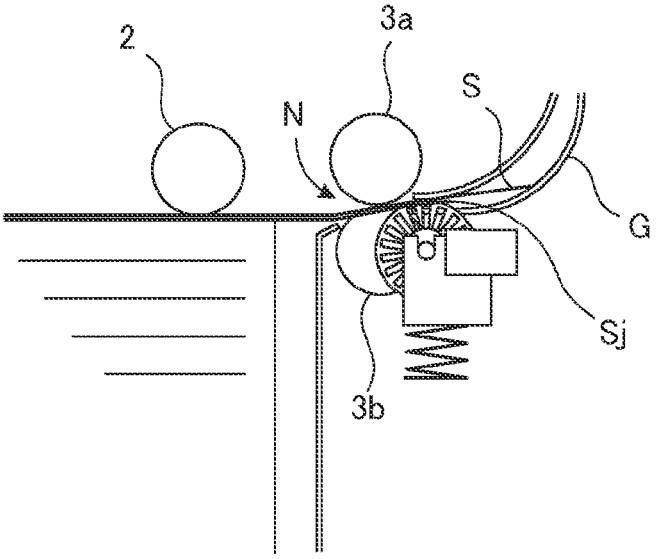
FIG. 6B is a diagram illustrating the second case of the double-feeding of sheets in the laser printer and showing a state after when the sheets are started to be fed.

The second case is a case when the second sheet Sj is doubly fed in a state in which the front ends of the uppermost sheet S and the second sheet Sj are shifted from each other within a certain range as shown in FIGS. 6A and 6B. In this case, the uppermost sheet S doubly fed in the previous feed operation is blocked by the separating roller 3*b* as shown in FIG. 6A. If a next feed operation is started in this state, the second sheet Sj of this time is doubly fed by the sheet S which has advanced to the separating roller 3*b*. In this case, the doubly fed sheet Sj is blocked by the separating nip portion N, so that a shift amount of the front ends of the two sheets S and Sj mostly falls within a range of a distance A from a front-end reference position of the sheet feeding cassette 1 to the separating nip portion N.

Figure 7A:
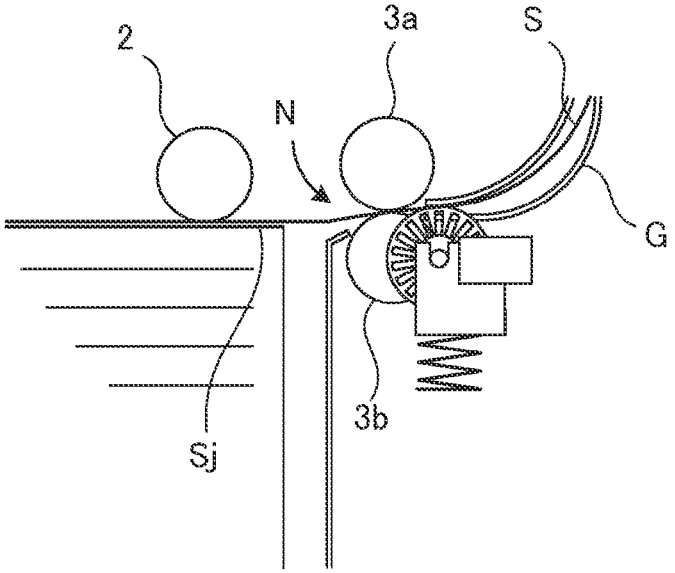
FIG. 7A is a diagram illustrating a third case of double-feeding of sheets in the laser printer and showing a state before when the sheets are started to be fed.
Figure 7B:
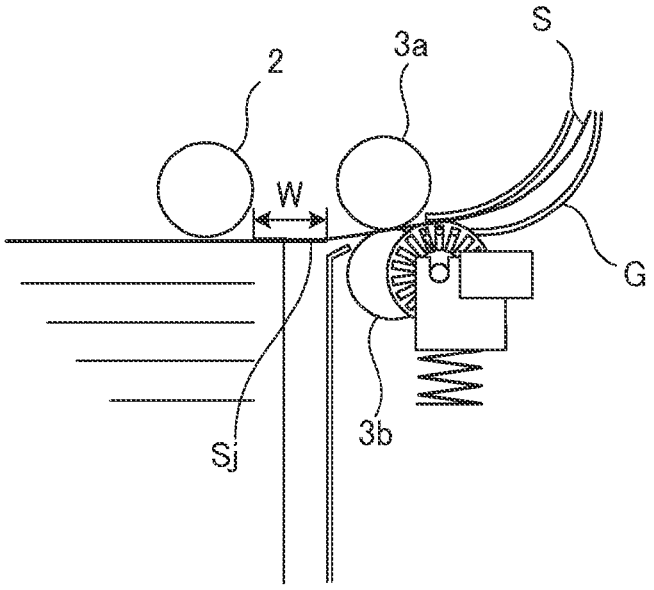
FIG. 7B is a diagram illustrating the third case of the double-feeding of sheets in the laser printer and showing a state after when the sheets are started to be fed.

The third case is a case when a preceding sheet S shown in FIGS. 7A and 7B is fed together with a doubly fed sheet Sj in a state in which a rear end of the preceding sheet S overlaps with a front end of the doubly fed sheet Sj. In a case of highly rigid thick sheets, there is a case when a force bending the sheet increases when the sheet S passes through the curved conveying guide G and the second sheet Sj is drawn out by the force. In this case, the doubly fed sheet Sj also passes through the separating nip portion N, so that a doubly fed amount of the sheet Sj increases and the shift amount of the front ends increases more than that of the second case.

Then, in these three cases, when the front end of the sheet passes through the curved conveying guide G after passing through the separating nip portion N, a friction force caused by a force bending the sheet, i.e., a resistance, is generated between the sheet and the conveyance guide G. Then, the friction force acts on the sheet as a conveyance resistance when the sheet passes through the curved conveying guide G. At this time, the doubly fed superordinate sheet S can pass through the curved conveying guide G by overcoming the conveyance resistance by a conveying force caused by friction with the conveying roller 3*a*. However, the doubly fed subordinate sheet Sj is stopped due to the conveyance resistance of the curved conveying guide G in addition to the conveyance load by the separating roller 3*b*.

Figure 8:
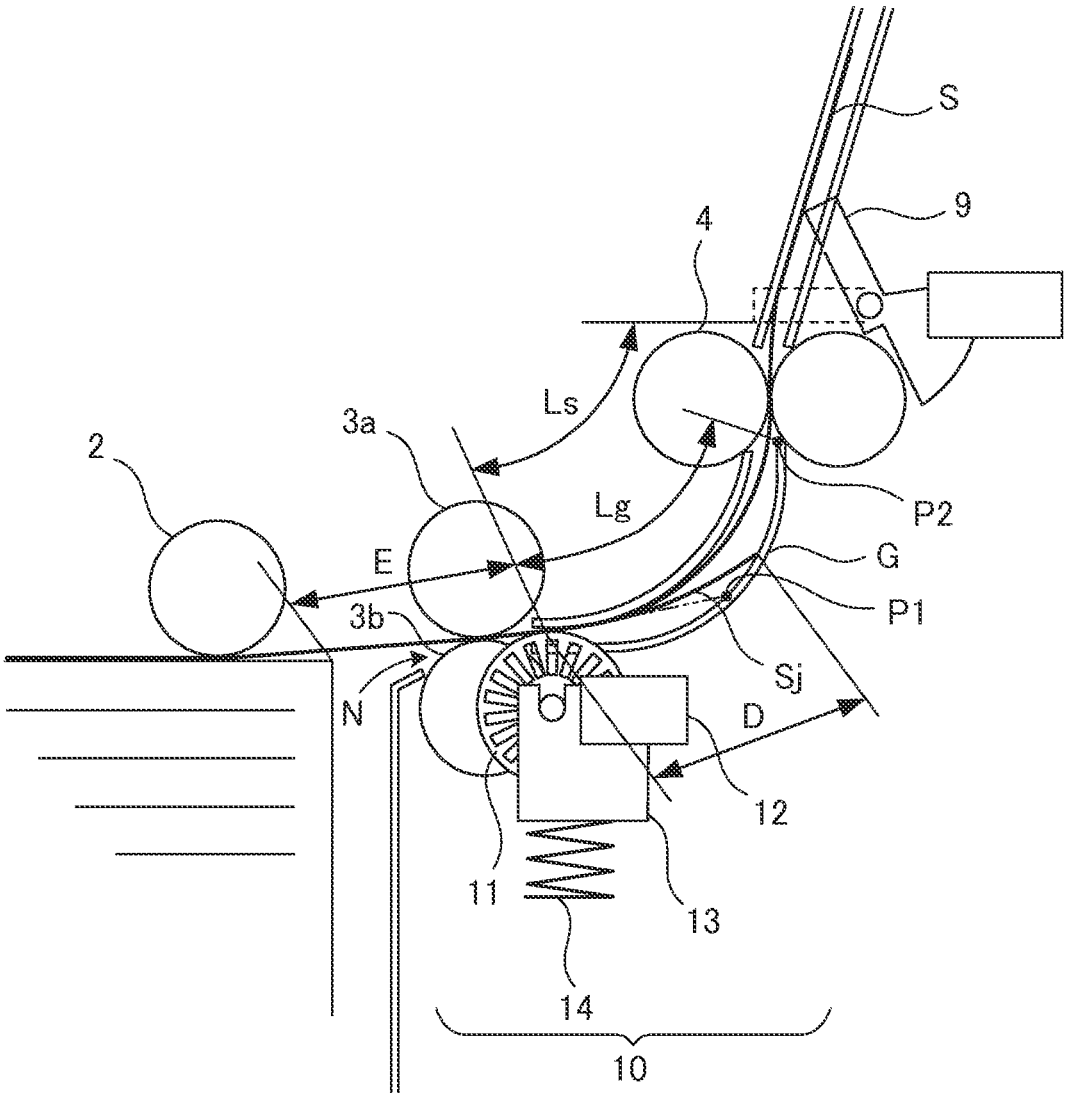
FIG. 8 illustrates a state when the doubly fed sheets are stopped in the laser printer.

FIG. 8 illustrates a state in which the doubly fed subordinate sheet Sj (referred to as a 'doubly fed sheet' hereinafter) is stopped by coming into contact with the conveyance guide G at a position separated by a distance D from the encoder 11. Here, the position where the doubly fed sheet Sj mostly stops within a range from which the doubly fed sheet Sj starts to receive the conveyance resistance from the conveyance guide G until which the doubly fed sheet Sj receives a new conveying force by the conveying roller pair 4. This range starts from a point P1 where a tangent line indicated by a two dot chain line drawn from the separating nip portion N on the outer circumference of the encoder 11 comes into contact with the conveyance guide G to a point P2 where the sheet comes into contact with the conveying roller pair 4.

It is noted that the position where the doubly fed sheet Sj stops is set up to the point P2 in the present embodiment. This is because the doubly fed sheet Sj is also conveyed downstream in the sheet conveying direction by receiving the new conveying force from the conveying roller pair 4 if the doubly fed sheet Sj arrives at the conveying roller pair 4 by passing the point P2 where the doubly fed sheet Sj comes into contact with the conveying roller pair 4 in all of the three double-feeding cases described above. Such case is handled as inconsistent in size or double-feeding and the sheet is forcibly discharged by skipping an image forming process for example.

Next, a control on a timing for starting a next feed operation made based on the moving distance L of the sheet obtained from the output of the pulses of the encoder 11 in the case when the double-feeding of the three cases described above has occurred will be described by dividing into four patterns. The moving distance of the first sheet obtained from the output of the pulses of the encoder 11 will be denoted as L1, the moving distance of the sheet obtained by the second feed operation will be denoted as L2, and a distance from a sheet feeding reference position to a part where the sheet comes into contact with the encoder 11 (referred to as an 'encoder contact part' hereinafter) will be described as a double feeding distance E, hereinafter. Still further, a distance from the encoder contact portion to the point P2 where the sheet comes into contact with the conveying roller pair 4 will be denoted as Lg, and a distance from the encoder contact portion to the conveyance sensor 9 will be denoted as Ls. The following explanation will be also made by assuming that the doubly fed superordinate sheet arrives at the conveying roller pair 4 and is normally conveyed in any cases. Still further, the determination of the respective patterns will be made by adequately adding or subtracting a margin $\alpha$ including a measurement error, a control error and the like.

The first pattern is a case when a moving distance L (referred to as a 'calculated moving distance' hereinafter), i.e., a moving amount of the sheet, detected by the moving amount detecting portion 10 and obtained from the encoder 11 is less than the distance Lg to the point P2 ($L<Lg$). In a case of this pattern, a stop position of the doubly fed sheet is assumed to be a position before the conveying roller pair 4. In this case, the control portion 200 delays a next feed operation starting timing by a time corresponding to a conveying distance L2+E in which the doubly fed distance E from the sheet feeding reference position to the encoder contact portion is added to the calculated moving distance L.

That is, the control portion 200 delays the next feed operation starting timing if the calculated moving distance L is shorter than the distance between the moving amount detecting portion 10 and the conveying roller pair 4 when the first (nth) sheet is fed. Specifically, the control portion 200 start the feed operation of the second (n+1th) sheet after an elapse of a time y which is longer than the predetermined time x for starting the feed operation of the second sheet and shorter than a fixed time z which is set based on the distance between the moving amount detecting portion 10 and the conveying roller pair 4. The control portion 200 also sets such that the longer the calculated moving distance L, the longer the time y is if the calculated moving distance L is shorter than the distance between the moving amount detecting portion 10 and the conveying roller pair 4 when the first sheet is fed.

The second pattern is a case when the calculated moving distance L exceeds the distance Lg to the point P2 in the first pattern and is shorter than the sheet length Lc, i.e., Lg≤L<Lc. In the case of this pattern, the stop position of the doubly fed sheet can be assumed to be a position in contact with the conveying roller pair 4. Because the doubly fed sheet Sj has arrived at the conveying roller pair 4 in this case, the control portion 200 delays the next sheet feed operation starting timing by a time corresponding to a conveying distance Lg+E in which the doubly fed distance E is added to the distance Lg from the encoder contact portion to the point P2. That is, the control portion 200 starts the feed operation of the second sheet after an elapse of a time z in the case when the calculated moving distance L is longer than the distance between the moving amount detecting portion 10 and the conveying roller pair 4 and shorter than the sheet length Lc when the first sheet is fed.

The third pattern is a case when the calculated moving distance L coincides with the sheet length Lc, i.e., L=Lc. Because the sheet is normally fed in this case, the next sheet is also fed normally. The fourth pattern is a case when the calculated moving distance L exceeds the sheet length Lc, i.e., L>Lc. Such case is handled as inconsistent in sheet size and the sheet is forcibly discharged by skipping an image forming process and a next feed operation is stopped for example.

Next the first and second patterns will be explained in detail. It is noted that the third pattern is the case of normal conveyance and the fourth pattern is a case when the succeeding (doubly-fed) sheet Sj doubly fed while shifting its front end from that of a preceding sheet passes through the conveyance guide G without stopping. Since the third and fourth patterns are managed in the same manners with the conventional methods, their explanation will be omitted here.

Figure 9A:
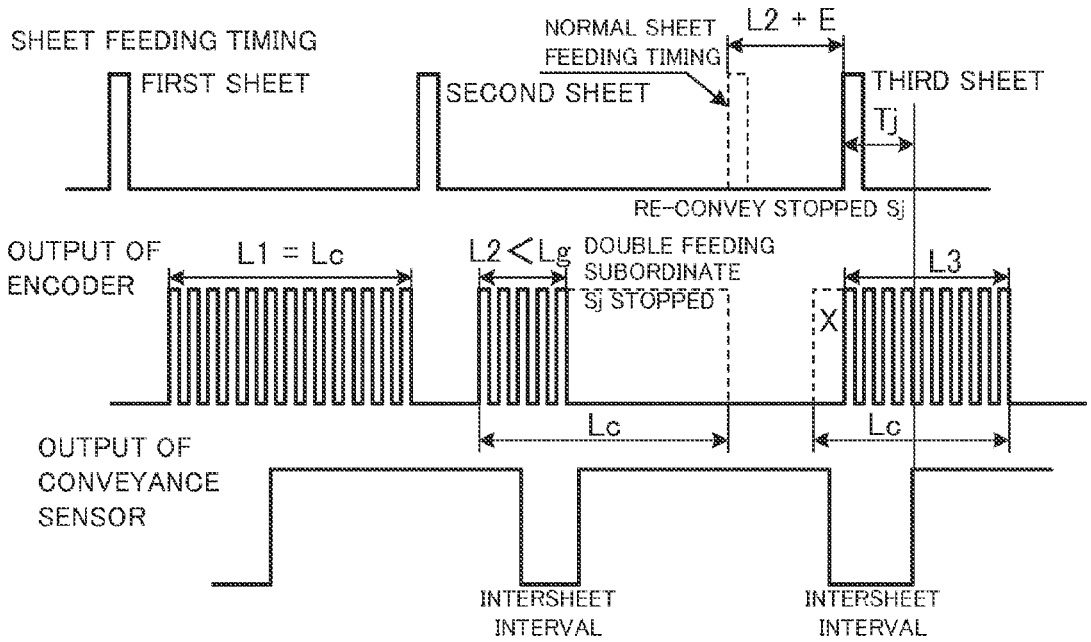
FIG. 9A illustrates output waveforms of the moving amount detecting portion and the conveyance sensor when the doubly fed sheets are stopped in the first pattern.

FIG. 9A illustrates output waveforms in the case of the first pattern in which the doubly fed sheet Sj stops by advancing by the distance L2 which is shorter than the distance Lg from the encoder contact portion to the point P2 in contact with the conveying roller pair 4, i.e., L2<Lg. Here, the encoder 11 is pressed in the sheet direction together with the holder 13 by the pressure spring 14 and follows the sheet without slip, so that the encoder 11 stops at a moment when the doubly fed sheet Sj stops. Thereby, the output of the pulses is interrupted.

It is noted that because the calculated moving distance L2 coincides with the moving distance of the doubly fed sheet Sj from the encoder 11 in the double feeding of the case 1 in which the front ends of the sheets are aligned, the control portion 200 can convey the sheet while maintaining the inter-sheet intervals by delaying the next feed operation by a time corresponding to the calculated moving distance L2. Still further, because the front ends of the doubly fed superordinate and subordinate sheets are shifted like the second and third doubly feeding cases, the calculated moving distance L2 does not coincide with an actual stop position of the doubly fed sheet Sj. That is, the moving distance of the subordinate sheet is shortened by the shift of the front ends of the doubly fed superordinate and subordinate sheets.

Therefore, while the inter-sheet interval is widened more than a predetermined inter-sheet interval in feeding the next sheet by the shift of the front ends in the cases where there is the shift of the front ends like the second and third double feeding cases, it is possible to continue the conveyance by eliminating such a trouble that a rear end of a preceding sheet overlaps with a front end of a sheet fed again after the stoppage. Then, if the next sheet feeding and conveying operations are normally conducted, the inter-sheet intervals return to normal inter-sheet intervals after that, so that this control affects nothing operationally.

Figure 9B:
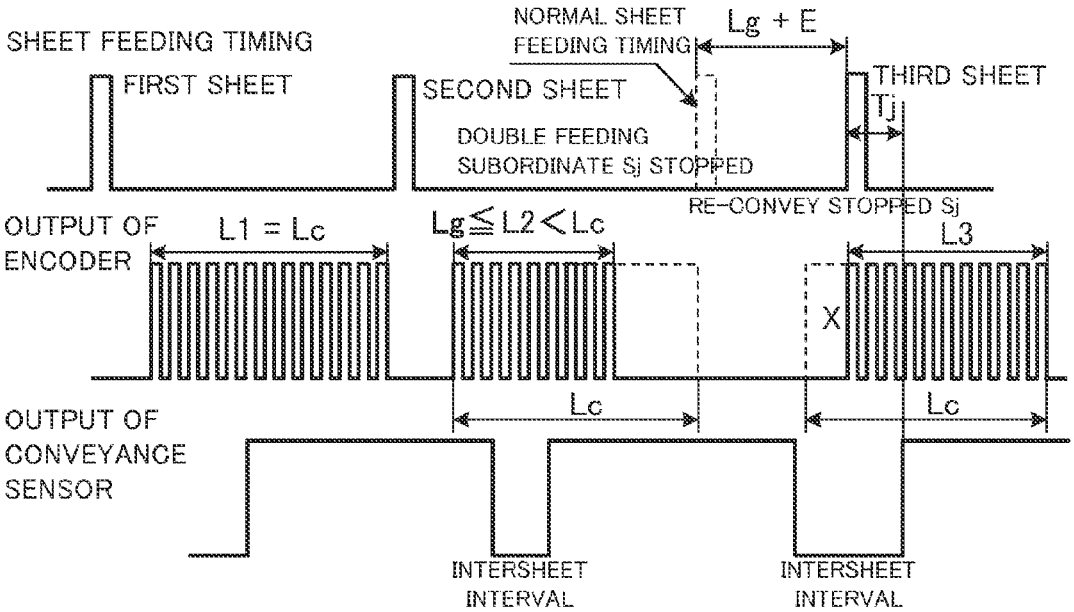
FIG. 9B illustrates output waveforms of the moving amount detecting portion and the conveyance sensor when the doubly fed sheets are stopped in the second pattern.

FIG. 9B illustrates output waveforms of the sensor in the case of the second pattern in which the doubly fed sheet Sj stops after advancing from the encoder contact portion by the distance shorter than the sheet length Lc, i.e., Lg≤L2<Lc. In this case, while it is judged that the sheet is stopped on the way of its conveyance because the calculated moving distance L2 is shorter than the sheet length Lc, the calculated moving distance L2 turns out to be Lg≤L2<Lc only in the cases of the second and third double feeding cases in which the front ends of the sheets are shifted.

In the first double feeding case in which the front ends are aligned, if the front end of the doubly fed sheet Sj passes through the point P2, i.e., Lg<L2, the doubly fed sheet Sj is nipped by the conveying roller pair 4 and obtains a new conveying force, so that the doubly fed sheet Sj is conveyed downstream together with the superordinate sheet S and is discharged as a doubly fed sheet. Therefore, the doubly fed sheet Sj will not stop within the assumed range of the second pattern in the first double feeding case in which the front ends are aligned.

Whereas, in the case of the second and third double feeding cases in which the front ends are shifted, because the calculated moving distance L2 is a sum of a stopped distance of the doubly fed sheet Sj and a length of the shift of the front end of the doubly fed superordinate sheet, there is a case when the calculated moving distance L2 exceeds the distance Lg to the point P2. Here, because the encoder 11 is unable to detect the shift amount between the superordinate sheet S and the doubly fed sheet Sj, an accurate position where the front end of the doubly fed sheet Sj has stopped is unknown. However, because the calculated moving distance L2 calculated from the encoder 11 which is in contact with the doubly fed sheet is less than the sheet length Lc, it is determined (assumed) that the doubly fed sheet Sj has stopped within the range from the encoder contact portion to the position of the point P2 just before the position where the sheet can obtain the new conveying force.

By assuming that the front end of the stopped sheet is located at the point P2 which is protruding most downstream in the conveying direction from the assumption described above, the control portion 200 delays the next feed operation starting timing by a time corresponding to a conveyance time of a distance Lg+E in which the double feeding time E is added to the distance Lg from the encoder contact portion to the point P2. Although the inter-sheet interval is widened more than that of a normal one in this case, it is possible to continuously convey the sheets by eliminating such trouble that the rear end of the preceding sheet overlaps with a front end of a sheet fed again after the stoppage. Then, if the next sheet feeding and conveying operations are normally conducted, the inter-sheet intervals return to normal inter-sheet intervals after that, so that this control affects nothing operationally.

By the way, the front end of the subordinate sheet Sj doubly fed and stopped in the second feed operation has already passed the encoder 11 as shown in FIG. 8. If this sheet Sj is conveyed again by changing a feed timing in a third feed operation, two outputs of pulses L3 of the encoder 11 obtained in the third conveying operation becomes shorter than the sheet length Lc in the conveying direction of the sheet as shown in FIGS. 9A and 9B.

If the control is left like this, the control is shifted to the changes of feed timing in the first or second pattern. In order to prevent that, the control is arranged such that the stopped distance where the doubly fed sheet Sj has stopped in the second feed operation is calculated. The feed timing of the third feed operation is changed by using this calculated stopped distance. Along with the change of the feed timing, the output pulse L3 of the encoder 11 in the third feed operation is corrected.

To that end, the control portion 200 calculates the position where the front end of the sheet has stopped at the second feed operation by measuring a time Tj when the conveyance sensor 9 shown in FIGS. 9A and 9B measures the front end of the sheet at first since the start of the third feed operation. Then, the control portion 200 calculates a distance Tj×Vp from the position where the front end of the sheet has stopped to the conveyance sensor 9 by multiplying the measure time Tj with conveying speed Vp. Then, a value (Ls−Tj×Vp) obtained by subtracting the distance Tj×Vp between the front end of the sheet and the conveyance sensor 9 from a distance Ls from the encoder contact portion to the conveyance sensor 9 becomes a stopped distance D of the doubly fed sheet Sj of the second feed operation shown in FIG. 8.

That is, a correction value Lm=L3+Ls−Tj×Vp obtained by adding the stopped distance D (Ls−Tj×Vp) described above to the calculated moving distance L3 when the third feed operation is conducted is a correct moving distance by which the doubly fed sheet Sj has passed through the encoder 11. Then, the control portion 200 judges whether or not the third feeding and conveying operations have been normally conducted by substituting this correction value Lm with the calculated moving distance L obtained in a normal conveyance in the next feed operation conducted by changing the feed timing and reflects the judgment to feed timing of a fourth feed operation.

By the way, it is necessary to confirm a calculated moving distance $L_{-1}$ of a final sheet in a previous print instruction when the laser printer 100 starts a first feed operation by receiving a next print instruction after conducting an image forming operation under the previous print instruction. If the calculated moving distance $L_{-1}$ of the previous final sheet is shorter than the sheet length Lc in the conveying direction of the sheet, it is judged that the previous final sheet has stopped by passing through the contact portion of the encoder 11, so that the same correcting process as described above is conducted.

That is, the control portion 200 shifts the process to the correcting process of measuring the sheet arrival time Tj to the conveyance sensor 9 since the start of a first feed operation and finds a correct calculated moving distance by the encoder 11 to reflect the correction to a next feed operation. If the previous final sheet has been conveyed normally, i.e., $L_{-1}$=Lc, a moving distance L of the sheet is measured by the encoder 11 in the normal feed operation. If the pulse output $L_{-1}$ of the encoder 11 of the previous final sheet exceeds a value in which the margin described above is added to the sheet length Lc, i.e., $L_{-1}$>Lc+margin, the sheet is disposed as mismatch in size and the like. Accordingly, the normal conveying operation is conducted also in this case without conducting the correction process.

Figure 10:
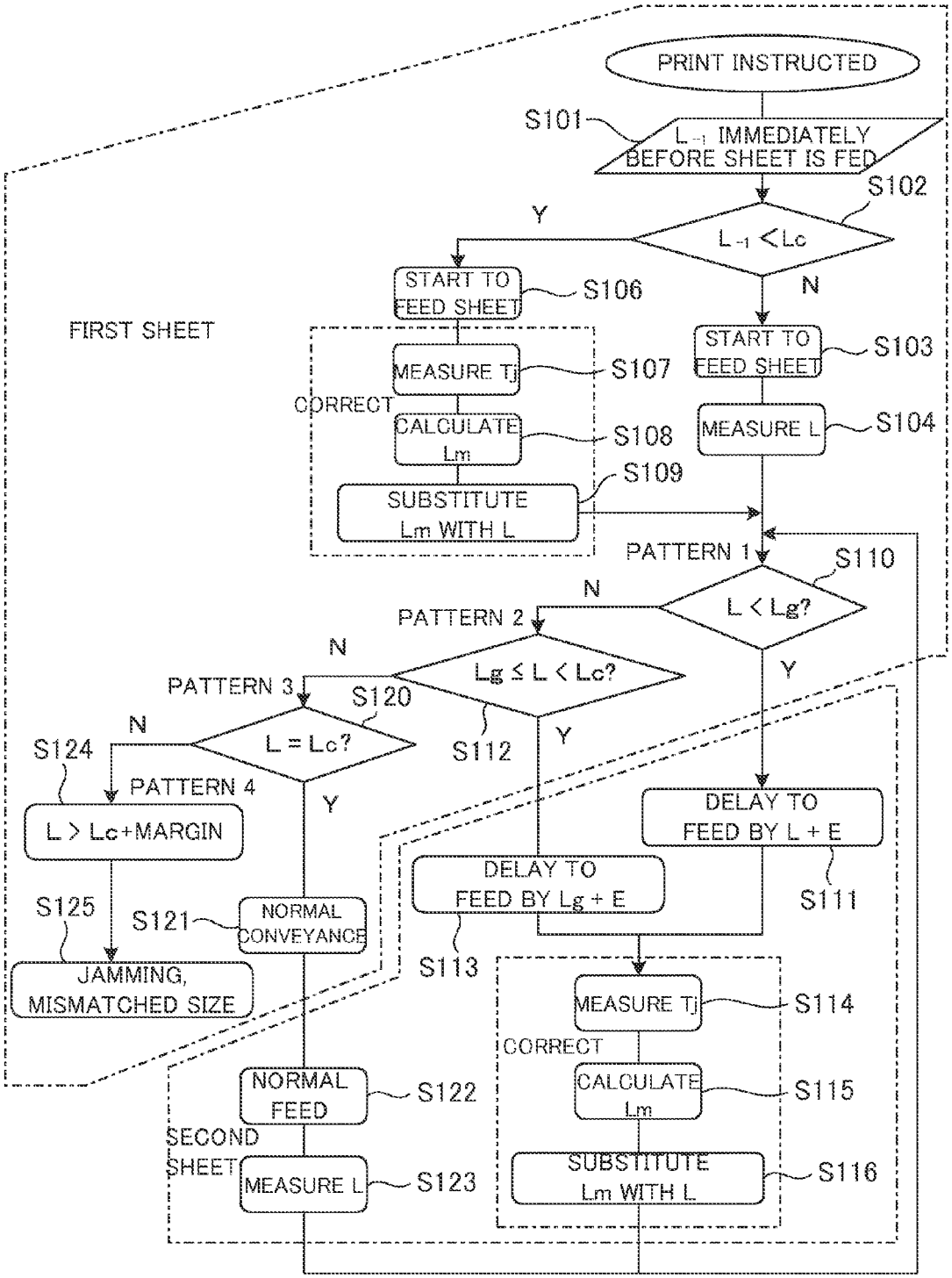
FIG. 10 is a flowchart illustrating a sheet feed operation starting timing control corresponding to a stopping position of the doubly-fed sheets of the laser printer.

Next, the control of the starting timing of the feed operation corresponding to the stopped position of the doubly fed sheet as described will be explained with reference to a flowchart shown in FIG. 10. At first, if a print instruction is sent to the laser printer 100, the control portion 200 reads a calculated moving distance calculated from a pulse output of the encoder 11 of a previous final sheet, i.e., a calculated moving distance $L_{-1}$ of a just previously fed sheet, from a memory not shown in Step S101. Next, the control portion 200 compares the calculated moving distance $L_{-1}$ with a sheet length Lc in Step S102. Then, if the comparison result is not $L_{-1}$<Lc, i.e., No in Step S102, the control portion 200 starts to feed a first sheet in Step S103 and measures a moving distance L of the sheet by the rotation of the encoder 11 in Step S104. Next, the control portion 200 judges whether or not the calculated moving distance L of the sheet obtained from the rotation of the encoder 11 is less than the distance Lg (L<Lg) to the point P2 in contact with the conveying roller pair 4 in the first pattern in Step S110.

Still further, in a case when $L_{-1}$<Lc, i.e., Yes in Step S102, the control portion 200 judges that the previous final sheet is present by passing through the encoder 11 and starts to feed a first sheet in Step S106. Then, the control portion 200 measures a sheet arrival time Tj to the conveyance sensor 9 in Step S107 and based on the sheet arrival time Tj, calculates a correction value Lm of the calculated moving distance L in Step S108. Then, the control portion 200 substitutes the correction value Lm of the calculated moving distance L with the calculated moving distance L of the first fed sheet in Step S109.

After conducting the correction as described above, the control portion 200 judges whether or not the calculated moving distance L is less than a distance Lg to the point P2 in contact with the conveying roller pair 4 (L<Lg) of the first pattern in Step S110. If the calculated moving distance L is less than the distance Lg, i.e., L<Lg and Yes in Step S110, the control portion 200 judges that the doubly fed sheet has stopped on its way within a range up to the moving distance Lg. Then, the control portion 200 delays a feed operation of a second sheet by a time for conveying the sheet for a distance L+E in which a doubly feeding distance E is added to the calculated moving distance L in Step S111.

Still further, in a case when the calculated moving distance L is not less than the distance Lg, i.e., not L>Lg or No in Step S110, the control portion 200 judges next whether or not the calculated moving distance L exceeds the distance Lg up to the point P2 in contact with the conveying roller pair 4 of the second pattern and is less than the sheet length Lc (Lg≤L<Lc) in Step S112. If the calculated moving distance L meets Lg≤L<Lc, i.e., Yes in Step S112, the control portion 200 judges that the doubly fed sheet has stopped at the point P2 in contact with the conveying roller pair 4. In this case, the control portion 200 delays the feed operation of the second sheet by a time for conveying the sheet for a distance Lg+E in which the distance E from the sheet reference position to the encoder contact portion is added to the distance Lg up to the point P2 in contact with the conveying roller pair 4 in Step S113.

It is noted that the control portion 200 corrects the calculated moving distance after thus delaying the feed operation of the second sheet by the time for conveying the sheet for the distance Lg+E in Step S113 and after delaying the feed operation of the second sheet by the time for conveying the sheet for the distance L+E as described above. That is, in the case of the first and second patterns in which the calculated moving distance is shorter than the sheet length Lc (L<Lg, Lg≤L<Lc), the front end of the doubly fed sheet has stopped at the position passing through the encoder 11. Therefore, the control portion 200 measures a time Tj from the start of the feed operation until when the conveyance sensor 9 detects the front end of the sheet in the feed operation of the second sheet in Step S114 and calculates a position where the front end of the sheet has stopped from conveying speed Vp and a distance Ls from the encoder 11 to the conveyance sensor 9. Then, after obtaining the correction value Lm by summing the calculated moving distance in the feed operation of the second sheet in Step S115, the control portion 200 substitutes the correction value Lm with the calculated moving distance L obtained in normal conveyance in Step S116 to judge whether or not feed timing of a third sheet should be changed.

If the case is not Lg≤L<Lc, i.e., No in Step S112, the control portion 200 judges next whether or not the calculated moving distance L is equal to the sheet length Lc of the third pattern in Step S120. Then, if the calculated moving distance L is equal to the sheet length Lc, i.e., Yes in Step S120 and L=Lc, the control portion 200 conducts normal conveyance in which the feed operation of the second sheet is started at the normal timing in Step S121. After that, the control portion 200 also conducts the normal feed operation to the second sheet in Step S122, then measures the calculated moving distance L of the second sheet in Step S123, and judges feed timing of a third sheet by using the calculated moving distance L. Still further, in a case when the calculated moving distance L of the fourth pattern is not equal to the sheet length Lc, i.e., No in Step S120 and the calculated moving distance L is larger than a value in which the margin is added to the sheet length Lc of the fourth pattern in Step S124, the control portion 200 judges that jamming or mismatch in size has occurred in Step S125. Then, the control portion 200 conducts such handling as a skip of an image forming process.

As described above, in the present embodiment, the control portion 200 estimates the stopped position of the front end of the doubly fed sheet Sj based on the number of output pulses generated by the rotation of the encoder 11. Then, the control portion 200 delays the starting timing of the next feed operation by the time corresponding to the calculated moving distance in the case when the control portion 200 estimates that the stopped doubly fed sheet Sj is stopping within the range from the encoder contact portion to the point P2. This configuration makes it possible to continuously conduct the feed operations on and after that because the rear end of the preceding sheet does not overlap with the front end of the succeeding sheet.

That is, the sheet feeding apparatus of the present embodiment is configured to estimate a position where the succeeding sheet fed with the preceding sheet has stopped and delays a feed starting timing of a next sheet by a time corresponding to the estimated stopped position. In other words, in consecutively feeding sheets, the sheet feeding apparatus is configured to change the timing for starting the feed operation of n+1th sheet based on a detection result of the moving amount detecting portion 10 when an nth sheet has been fed. This configuration makes it possible to continuously conduct the image forming operations even when the succeeding sheet is fed together with the preceding sheet. In other word, it is possible to continue the image forming operation without judging as jamming even if the succeeding sheet fed with the preceding sheet stops.

It is noted that because the stopped position of the doubly fed succeeding sheet is estimated by using the encoder 11 rotating in contact with the sheet S in the configuration of the present embodiment, it is not necessary to review corresponding to types of the sheet. Therefore, this configuration does not require the user to specify the type of the sheet and can detect from a conveyance of a first sheet just after detecting the attachment of the sheet feeding cassette 1. This configuration also makes it possible to estimate a position where a doubly fed succeeding sheet has stopped without any problem even in a case when types of sheets are mixed.

<Second Embodiment>

Figure 11:
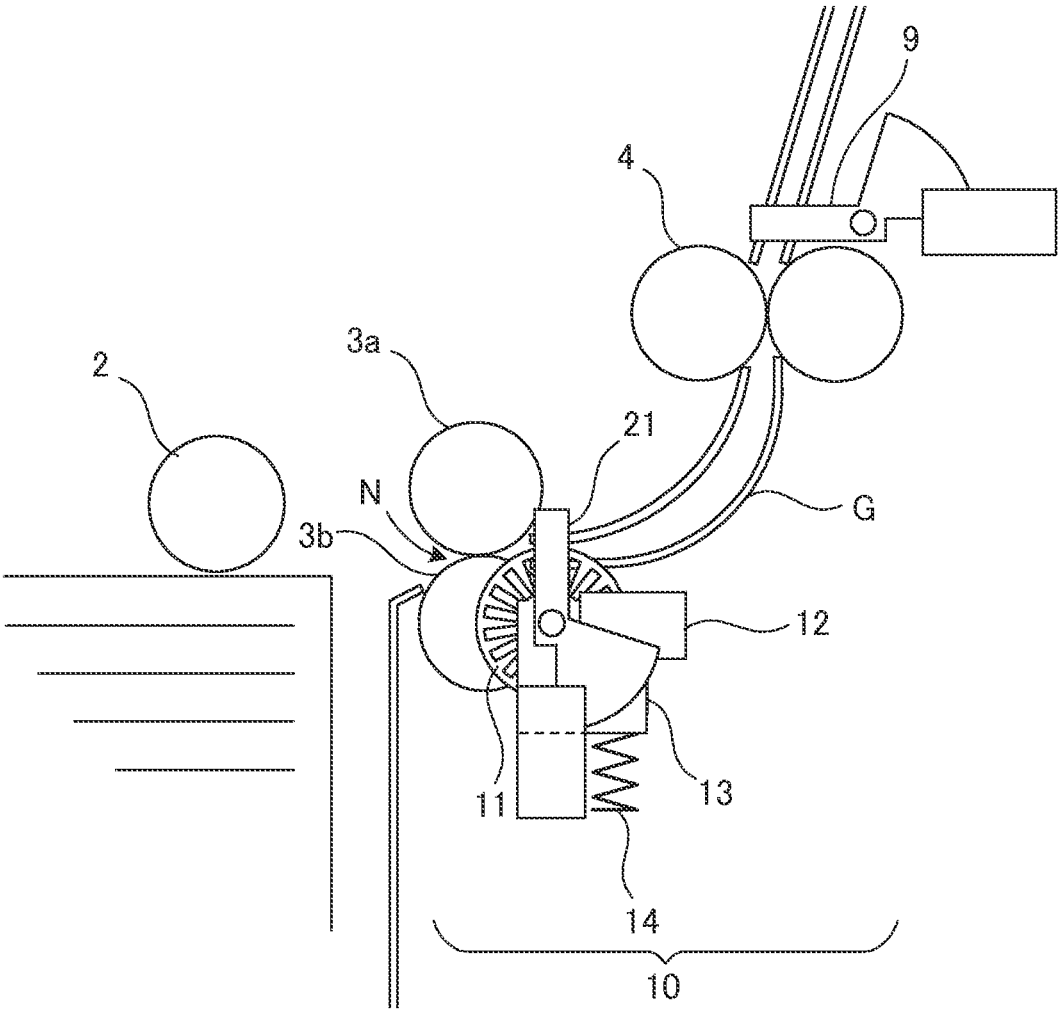
FIG. 11 is an enlarged view of a main part of a sheet feeding apparatus of a second embodiment of the present invention.

Next, a second embodiment of the present invention will be described. FIG. 11 is an enlarged view of a main part of a sheet feeding apparatus of the present embodiment. It is noted that in FIG. 11, the same reference numerals with those described in FIG. 2 denote the same or corresponding parts.

In FIG. 11, a sheet feeding apparatus 103 includes a conveyance sensor 21, i.e., a presence detecting portion, disposed right behind the separating nip portion N and in vicinity downstream in the sheet feeding direction of the moving amount detecting portion 10. It is possible to estimate a position where the sheet has stopped by the moving amount detecting portion 10 and to detect whether or not a final sheet in a previous print instruction is present while stopping by passing through the encoder contact portion by proving the conveyance sensor 21 as described above. That is, while it is confirmed whether or not a final sheet is stopping while passing through the encoder contact portion by the calculated moving distance $L_{-1}$ in starting the feed operation in the first embodiment, it can be confirmed by the conveyance sensor 21 in the present embodiment.

By the way, it is supposed to happen, even though very rare, such a case that a distance D where the doubly fed sheet Sj has stopped by passing through the encoder contact portion is equal to an overlap amount W of the rear end of the superordinate sheet S with the front end of the subordinate sheet Sj doubly fed in the third double feeding case shown in FIG. 7B. In this case, the calculated moving distance L is equalized with the sheet length Lc. In this case, the control portion 200 is unable to judge whether the stoppage of rotation of the encoder 11 is caused by the passage of the sheet or the stoppage of the subordinate sheet Sj. That is, this condition is recognized as a normal conveyance only by the encoder 11 and a situation in which the rear end of the preceding sheet overlaps with the front end of a next sheet occurs in a next feed operation. In order to prevent such situation, the conveyance sensor 21 is disposed substantially at the same position in the conveying direction with the encoder 11 in the present embodiment.

Still further, in the present embodiment, the sheet feeding apparatus is configured to confirm whether or not the conveyance sensor 21 detects the sheet in the case when the calculated moving distance L is equal to the sheet length Lc (L=Lc). Then, if the conveyance sensor 21 detects the sheet, it can be judged that the sheet S has stopped at the encoder contact portion. It is noted that because a position where the front end of the sheet has stopped is unknown in this case, it is assumed that the front end of the sheet has arrived at the point P2 in contact with the conveying roller pair 4 which is the downstream-most stopped position similarly to the case explained in the second pattern of the first embodiment. Then, the timing for starting a next feed operation is delayed by a time corresponding to a moving time of a distance Lg+E in which the double feeding distance E is added to the distance Lg to the point P2.

Figure 12:
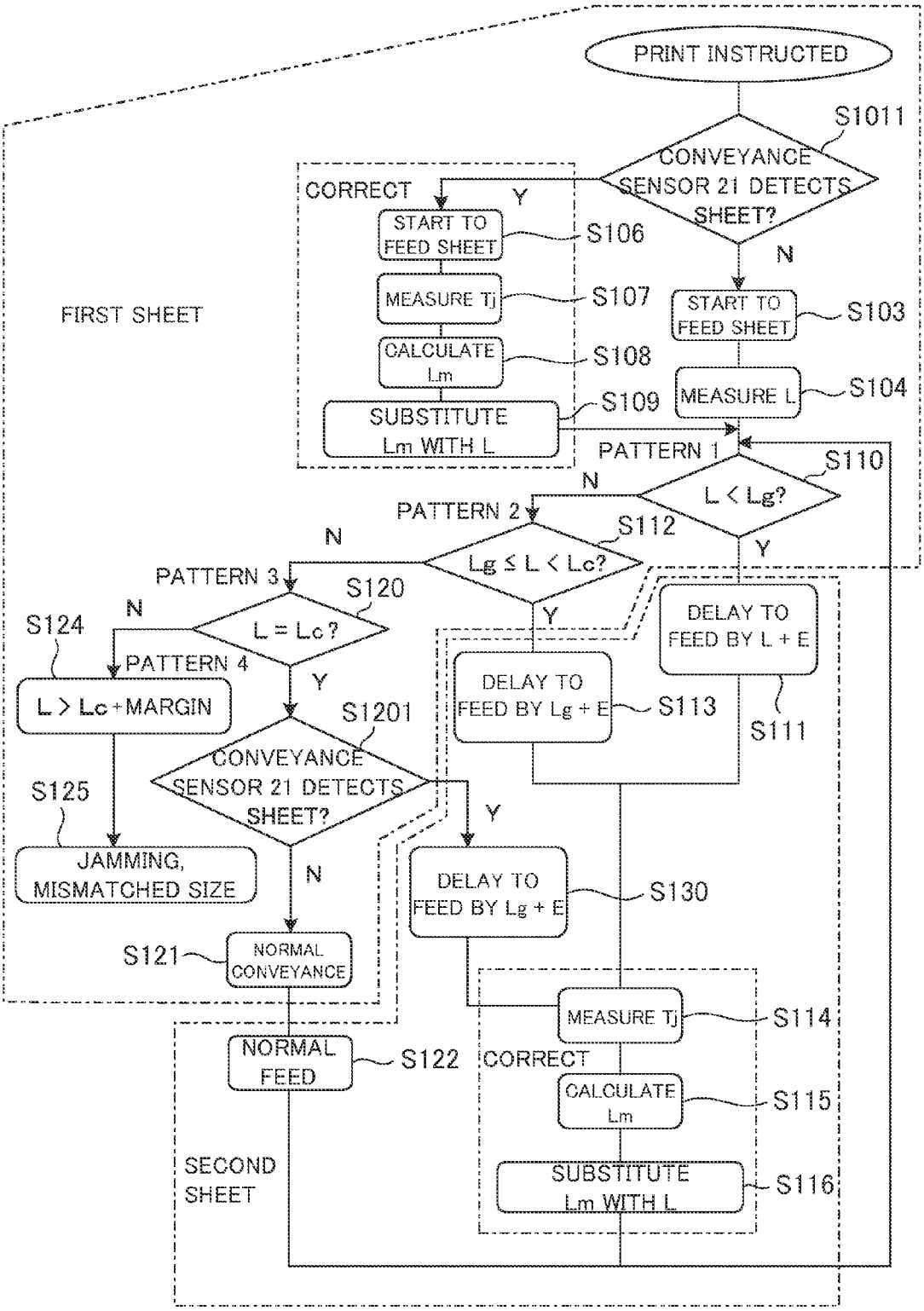
FIG. 12 is a flowchart illustrating a sheet feed operation starting timing control corresponding to a position of the doubly-fed sheets of the laser printer.

Next, the control of the present embodiment as described will be explained with reference to a flowchart shown in FIG. 12. In the present embodiment, if a print instruction is sent, the control portion 200 confirms whether or not the conveyance sensor 21 detects the sheet in Step S1011. If the conveyance sensor 21 does not detect any sheet, i.e., No in Step S1011, the control portion 200 judges that no sheet is present and starts a normal feed operation of a first sheet in Step S103 and measures a calculated moving distance L of the sheet by the rotation of the encoder 11 in Step S104. Next, the control portion 200 judges whether or not the calculated moving distance L of the sheet obtained from the rotation of the encoder 11 is less than the distance Lg (L<Lg) in Step S110.

Still further, if the conveyance sensor 21 detects the sheet, i.e., Yes in Step S1011, the control portion 200 starts a feed operation in Step S106 and also judges that a doubly fed sheet in a previous feed operation is present while passing through the encoder contact portion. Then, the control portion 200 measures a sheet arrival time Tj during which the first sheet arrives at the conveyance sensor 9 provided downstream of the conveyance sensor 21 since the start of its feed in Step S107 and based on the Tj, calculates a correction value Lm of the calculated moving distance L in Step S108. Then, the control portion 200 substitutes the correction value Lm of the calculated moving distance L with the calculated moving distance L of the first fed sheet in Step S109 and judges a feed timing of a second sheet by using the correction value Lm as the calculated moving distance L of the first sheet. It is noted that the calculated moving distance L of the sheet detected by the encoder 11 after that is in the cases of the first pattern (L<Lg), the second pattern (Lg≤L<Lc), and the fourth pattern (L>Lc), the same judgments and processes with those of the first embodiment are made.

Still further, in the present embodiment, in the case of the third pattern (L=Lc), the detection of the sheet by the conveyance sensor 21 is confirmed. That is, if the calculated moving distance L is equal to the sheet length Lc, i.e., Yes in Step S120 and L=Lc, the control portion 200 confirms whether or not the conveyance sensor 21 detects the sheet in Step S1201. If the conveyance sensor 21 detects the presence of the sheet, i.e., Yes in Step S1201, the control portion 200 judges that the doubly fed sheet has stopped.

Then, the control portion 200 delays a feed operation of a second sheet by a time for conveying the sheet for a distance Lg+E in which a doubly feeding distance E is added to the distance Lg to the point P2 in Step S130. After that, the control portion 200 measures a time Tj when the conveyance sensor 9 detects the front end of the sheet from starting of the sheet feeding in Step S114 and calculates a position where the front end of the sheet has stopped from conveying speed Vp and a distance Ls from the encoder 11 to the conveyance sensor 9. Then, after obtaining the correction value Lm by summing the calculated moving distance in the feed operation of the second sheet in Step S115, the control portion 200 substitutes the correction value Lm with the calculated moving distance L obtained in normal conveyance in Step S116 to judge whether or not feed timing of a third sheet should be changed. Still further, if the conveyance sensor 21 detects no sheet, i.e., No in Step S1201, the control portion 200 conveys the sheet normally in Step S121 and conducts a normal feed operation of a second sheet in Step S122.

As described above, in the present embodiment, the sheet feeding apparatus is arranged to estimate the stopped position of the doubly fed sheet by the moving amount detecting portion 10 and to detect whether the doubly fed sheet is present by the conveyance sensor 21 by adding the conveyance sensor 21 right after the separation nip. It becomes unnecessary to store data of immediately preceding moving distance in the control portion 200 and the control is simplified by detecting the presence of the doubly fed sheet by the conveyance sensor 21 as described above.

It is noted that while the case of obtaining the information on the length in the sheet feeding direction of the sheet from the size detecting portion 40 provided in the sheet feeding cassette 1 has been described in the first and second embodiments, the sheet length Lc may be set based on a sheet size specified by the user.

<Third Embodiment>

Figure 13:
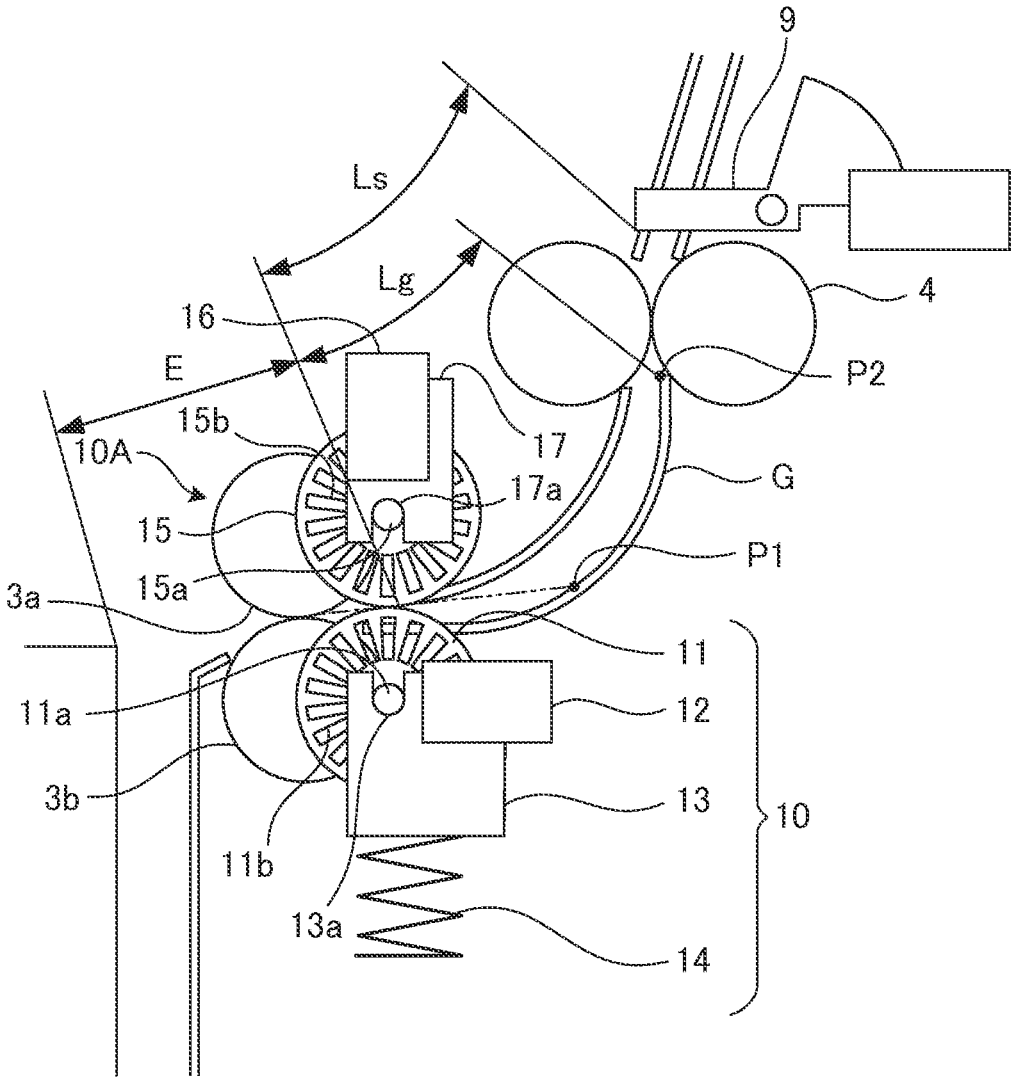
FIG. 13 is an enlarged view of a main part of a sheet feeding apparatus of a third embodiment of the present invention.

Next, a third embodiment of the present invention will be described. FIG. 13 is an enlarged view of a main part of a sheet feeding apparatus of the present embodiment. It is noted that in FIG. 13, the same reference numerals with those described in FIG. 2 denote the same or corresponding parts.

As shown FIG. 13, the sheet feeding apparatus 103 of the present embodiment includes an upper moving amount detecting portion (opposing-side moving amount detecting portion), i.e., a conveyance detecting portion, 10A provided on an upper surface side of the sheet S, i.e., a side coming in contact with the sheet feeding roller 2, and configured to judge whether or not a superordinate sheet has been normally conveyed. The upper moving amount detecting portion 10A includes an upper encoder 15 disposed above the encoder 11, a photo sensor 16 and a fixing holder 17 rotatably supporting the upper encoder 15 and fixing a photo sensor 16. It is noted that the upper encoder 15 has a shaft 15*a* and slits 15*b* formed in a radial direction centering on the shaft 15*a*. The photo sensor 16 is fixed to the fixing holder 17 at a position where its optical axis overlaps with the slits 15*b* of the upper encoder 15. The fixing holder 17 has a bearing portion 17*a* rotatably supporting the upper encoder 15 and a mount portion of the photo sensor 16 and is fixed to the printer body 101 of the image forming apparatus.

Then, the sheet feeding apparatus is configured such that the encoder 11 is pressurized by the pressure spring 14 to the upper encoder 15 and a sheet passes through a nip between the upper encoder 15 and the encoder 11. Such configuration makes it possible for the upper encoder 15 and the encoder 11 located on an upper surface side, i.e., the side of the sheet S coming into contact with the sheet feeding roller 2, to rotate following the sheet by the action of the pressure spring 14. Due to that, the control portion 200 can instantly determine whether the sheet and the succeeding sheet should be conveyed or stopped by signals from the moving amount detecting portion 10 and the upper moving amount detecting portion 10A.

That is, in the present embodiment, the control portion 200 judges whether the superordinate sheet has been normally conveyed or jammed by the upper encoder 15. It is possible to instantly determine the conveyance and stoppage of the sheet in a short time by judging whether the superordinate sheet has been normally conveyed by the upper encoder 15 as described above as compared to the case of judging whether or not the superordinate sheet has been normally conveyed by the conveyance sensor 9.

That is, in the present embodiment, the upper encoder 15 for use in judging the conveyance of the superordinate sheet is added on the encoder 11 to be able to detect conveyance states of the superordinate and subordinate sheets in case they are doubly fed. Then, the control portion 200 compares information of outputs of the encoder 11 with outputs of the upper encoder 15 to detects whether or not the doubly fed sheets have been stopped and estimates the stopped position of the sheet to use in changing the control on a next feed operation.

Here, in the present embodiment, a calculated moving amount of a sheet obtained from the pulse output of the upper encoder 15 is assumed as M, a calculated moving amount obtained from a first feed operation as M1, and a calculated moving amount obtained from a second feed operation as M2. Then, if the sheet length Lc obtained by the size detecting portion in the sheet feeding cassette 1 coincides with the calculated moving amount M obtained from the rotation of the upper encoder 15 (M=Lc), it is judged that the conveyance is normally conducted. If the calculated moving amount M is shorter than the sheet length Lc (M<Lc), it is judged that the sheet has stopped on the way of its conveyance and the user is urged to treat it as jamming.

If the calculated moving amount M is longer than the sheet length Lc (M>Lc), the sheet is judged to be mismatch in size and is forcibly discharged and its image forming process is skipped. In a case when the encoder 11 stops to rotate and the upper encoder 15 continues to rotate, it is judged that the sheets are doubly fed and the doubly fed subordinate sheet has stopped on the way of its conveyance.

Figure 14:
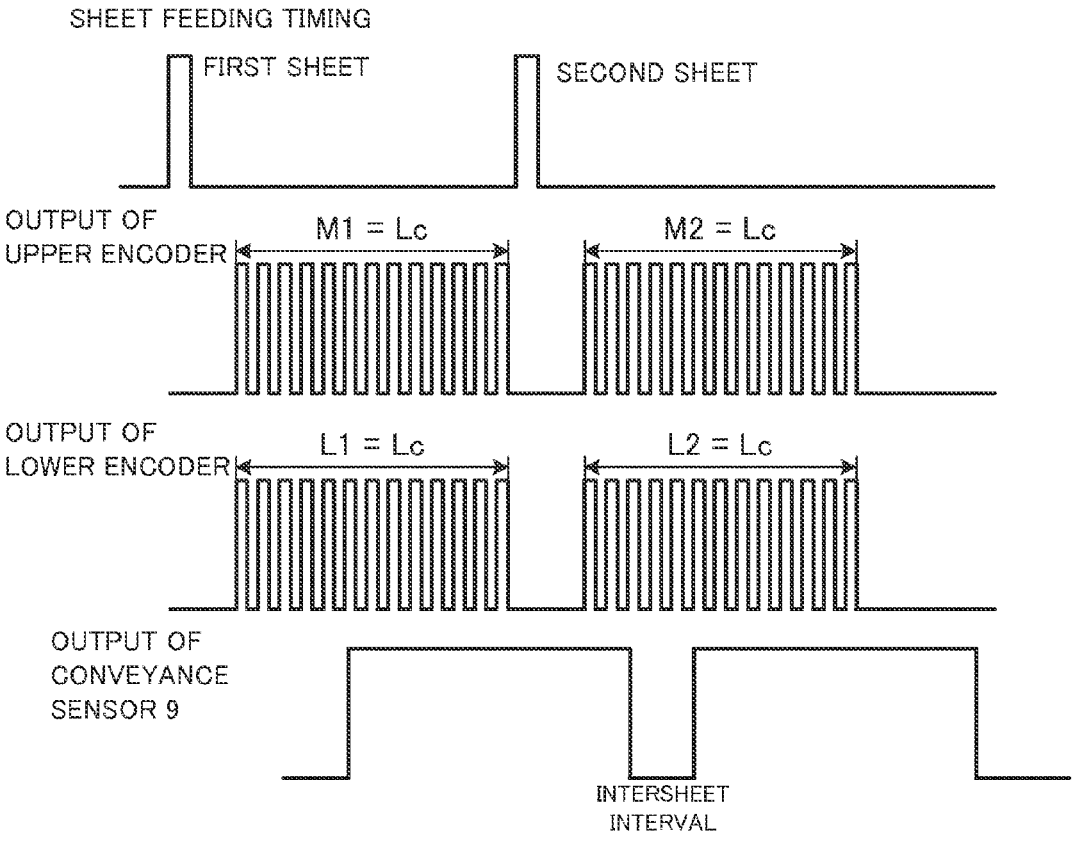
FIG. 14 illustrates output waveforms of the moving amount detecting portion and the conveyance sensor provided in the laser printer when sheets are normally conveyed.

Next, a treatment of the case when the conveyance of the sheet detected by the upper encoder 15 is normal and when the encoder 11 detects that the sheet has stopped will be explained. FIG. 14 illustrates output waveforms when the sheet is normally conveyed and FIG. 15 illustrates output waveforms when a doubly fed subordinate sheet has stopped on the way in a second feed operation.

As shown in FIG. 14, when the feed operation of a first sheet is started and the sheet arrives at a nip between the upper encoder 15 and the encoder 11, the encoders 15 and 11 rotate following the sheet and the two encoders start to generate pulses concurrently. After that, the sheet arrives at the conveying roller pair 4 and the conveyance sensor 9 detects an arrival of the sheet.

If a rear end of the sheet passes through the two encoder contact portions, the two encoders 11 and 15 stop to rotate and generate pulse outputs (M1=L1=Lc) of moving distances equal to the length Lc in the conveying direction of the sheet. After that, the conveyance sensor 9 detects that the rear end of the sheet passes through. In a second feed operation after that, similar output waveforms (M2=L2=Lc) are generated after an elapse of a predetermined inter-sheet interval.

Figure 15:
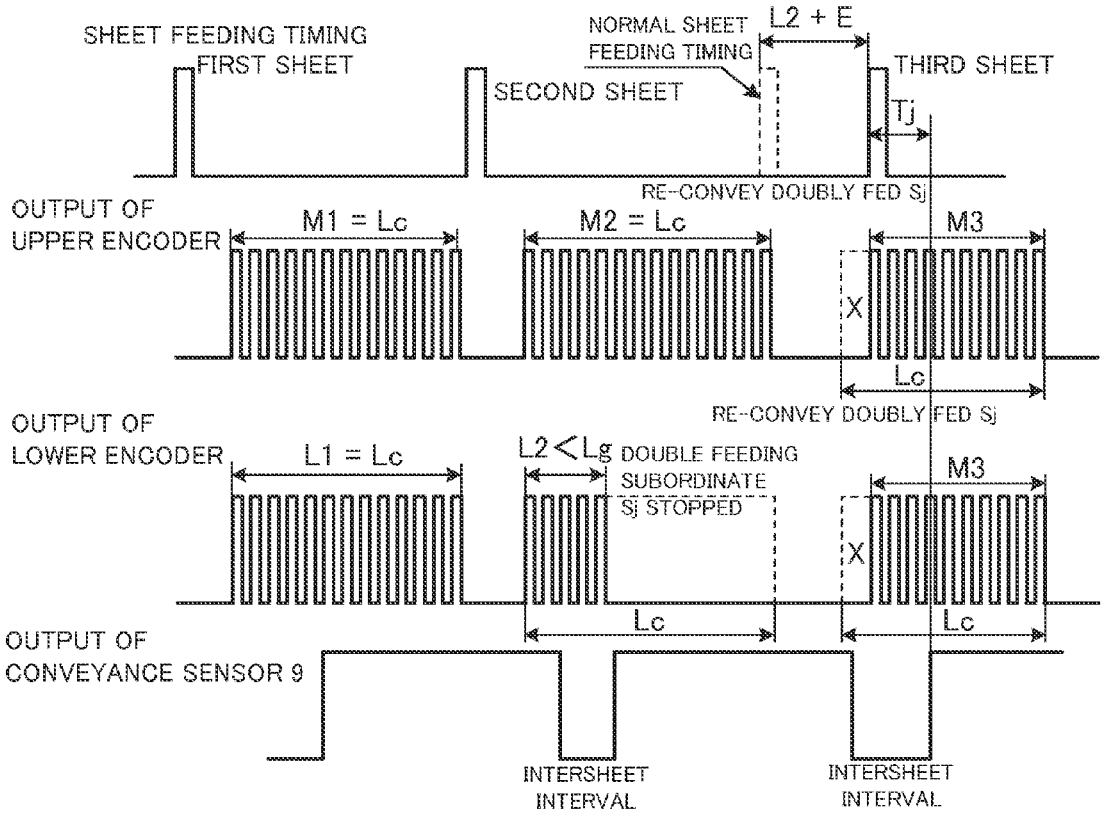
FIG. 15 illustrates output waveforms of the moving amount detecting portion and the conveyance sensor when the doubly-fed sheets are stopped.

FIG. 15 illustrates output waveforms of the encoder 11 and the upper encoder 15 when the doubly fed subordinate sheet Sj has stopped by advancing by a distance L2 shorter than a distance Lg from the encoder contact portion to the point P2 in contact with the conveying roller pair 4 in a second feed operation. The encoder 11 is pressed in the direction of the upper encoder 15 together with the holder 13 by the pressure spring 14, so that the two encoders 11 and 15 follow the sheet without slippage. Then, the encoder 11 stops and the pulse output is interrupted at a moment when the doubly fed subordinate sheet Sj stops (L2<Lg) and the encoder 11 outputs a waveform as shown in FIG. 15 as a result.

Still further, even if the doubly fed subordinate sheet Sj stops, the doubly fed superordinate sheet S obtains a conveying force from the conveying roller 3*a* and the conveying roller pair 4. Due to that, the upper encoder 15 outputs the waveforms as shown in FIG. 15 indicating that the doubly fed superordinate sheet S is normally conveyed. Then, the control portion 200 detects that the doubly fed superordinate sheet has normally passed through the nip of the two encoders from the waveform (M2=Lc) from the upper encoder 15.

Thus, in the present embodiment, it is possible to judge that the doubly fed subordinate sheet has stopped by confirming that the upper encoder 15 continuously outputs the pulses at the moment when it has been detected that the sheet has stopped by the encoder 11. This arrangement makes it possible to start to change the feed timing of a next sheet in an earlier stage because it is not necessary to wait until when the rear end of the sheet passes through the conveyance sensor 9 located downstream in the conveying direction.

It is noted that in the present embodiment, the doubly fed sheet is conveyed again in a third feed operation similarly to the first and second embodiments. Then, at this time, the correction process performed on the output pulse L3 of the encoder 11 is applied similarly to an output pulse M3 of the upper encoder 15. It is because it is necessary to also correct the output of the upper encoder 15 in the third feed operation because the upper encoder 15 also comes in contact with the stopped doubly fed sheet after when the normally conveyed doubly fed superordinate sheet passes through the nip of the two encoders.

It is noted that as such correction process, a distance where the doubly fed sheet has stopped is found from a time Tj when the conveyance sensor 9 detects the arrival of the sheet since the start of the third feed operation, a conveying speed Vp, and a distance from the contact portion of the two encoders to the conveyance sensor 9, i.e., Ls−Tj×Vp. Next, this stopped distance is added to the sheet moving distances L3 and M3 detected by the two encoders and obtained in the third feeding and conveying operation to set correction values Lm=L3+Ls−Tj×Vp and Mm=M3+Ls−Tj×Vp as distances by which the sheet has passed through from the two encoders. Then, these correction values Lm and Mm are used for judging feed timing of a fourth sheet.

As described above, in the present embodiment, it is possible to instantly discriminate whether the sheet has been conveyed or stopped by judging whether the superordinate sheet has been normally conveyed or jammed by the upper encoder 15. This arrangement makes it possible to start to change the feed timing of the next sheet in an earlier stage because it is not necessary to wait until when the rear end of the sheet passes through the conveyance sensor 9 located downstream in the conveying direction as described above.

By the way, the conveyance state of the sheet is detected by the encoder and the photo sensor in the description so far, the present invention is not limited such configuration. For instance, a non-contact type moving amount detecting portion using a light emitting portion and an image sensor may be also used.

<Fourth Embodiment>

Figure 16:
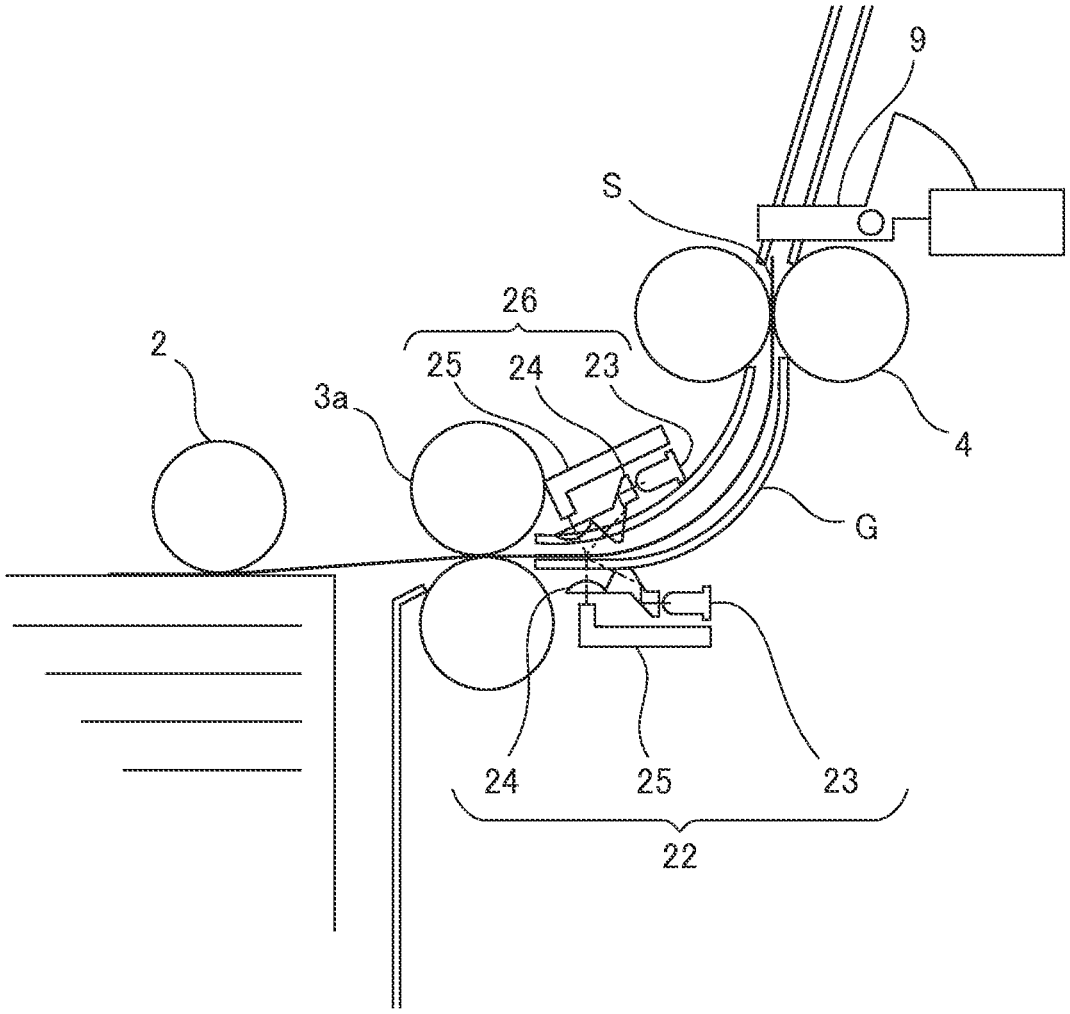
FIG. 16 is an enlarged view of a main part of a sheet feeding apparatus of a fourth embodiment of the present invention.

Next, a fourth embodiment of the present invention using such non-contact type moving amount detecting portion will be described. FIG. 16 is an enlarged view of a main part of a sheet feeding apparatus of the present embodiment. It is noted that in FIG. 16, the same reference numerals with those described in FIG. 2 denote the same or corresponding parts.

As shown in FIG. 16, the sheet feeding apparatus 103 includes an under-surface moving amount detecting portion 22 disposed on a back side, i.e., a side opposite from the upper surface of the sheet to which the sheet feeding roller 2 comes in contact, and an upper-surface moving amount detecting portion 26 disposed on the upper surface side of the sheet to which the sheet feeding roller 2 comes in contact. Here, the under-surface moving amount detecting portion 22 includes a light emitting portion 23 composed of LED and others and an optical lens (optical portion) 24 having a reflection surface reflecting light emitted from the light emitting portion 23. Then, the light emitted from the light emitting portion 23 is irradiated by the optical lens 24 to the surface of the sheet S passing through the conveying path. It is noted that the upper-surface moving amount detecting portion 26 also has the same configuration.

Then, in the present embodiment, a surface condition of the sheet S whose surface is irradiated by the light emitting portion 23 and the optical lens 24 and whose fine irregularity is cleared is detected by an image sensor 25 at predetermined intervals and is stored in a memory not shown. The control portion 200 compares the surface condition stored immediately before with the surface condition stored this time.

Here, the control portion 200 judges that the sheet S is stopping when the compared surface conditions are indifferent in a case the sheet S is stopping. The compared surface conditions differ if the sheet S is moving. Then, it is possible to detect a moving amount of the sheet S, i.e., to estimate a position where the sheet is stopping by finding a part common to the both surface conditions and by measuring how far the common part has shifted.

Thus, the stopped position of the sheet is estimated by using the non-contact under-surface moving amount detecting portion 22 and the upper-surface moving amount detecting portion 26 in the present embodiment. Then, it is possible to more stably convey the sheet without generating a sheet conveyance resistance by estimating the stopped position of the sheet in non-contact as described above.

It is noted that while the configuration using the encoder and the photo sensor as the moving amount detecting portion detecting the moving amount of the sheet or the non-contact moving amount detecting method of detecting the surface of the sheet by the image sensor have been described above, the present invention is not limited to those configurations. It is needless to say that the movement may be detected by any method such a method of detecting the moving speed of the sheet by a laser Doppler system for example. Still further, while the case when the doubly fed sheet Sj has stopped near the separation nip in the first through fourth embodiments described above, this position is not limited. For instance, it is needless to say that it may be possible to detect a conveyance condition of the sheet by providing the moving amount detecting portion downstream in the sheet conveying path of the conveying roller if there is a part generating a conveyance resistance downstream of the conveying roller in the conveying path through which the sheet is conveyed.

Still further, while the image forming apparatus including the sheet feeding apparatus 103 configured to feed a sheet out of the sheet feeding cassette 1 has been explained in the above description, the present invention is not limited to such configuration. The present invention is applicable also to a document feeder such as a side deck configured to feed a document and a manual feeder.

<Fifth Embodiment>

By the way, lately, demands in the market on quality and performance of an image forming apparatus is increasing more and more. However, such demands include not only an improvement of image forming speed, i.e., an increase of number of sheets which can be outputted within a certain period of time, but also such items that are contrary to the improvement of the image forming speed such as a cut of power consumption, noise reduction, and extension of life. In order to meet with these demands, it is necessary to shorten a distance between a sheet on which an image is being formed and a succeeding sheet (referred to as an 'inter-sheet distance' hereinafter).

It is noted that if the inter-sheet distance can be shortened as described above, a sheet conveying speed required to achieve the same image forming speed can be delayed. This arrangement makes it possible to delay driving speed of motors and to reduce power consumption and operation noise. Still further, because the more the inter-sheet distance is cut, the more a total number of rotations of the driving system can be reduced, so that it is possible to suppress wear of components of the image forming portion from advancing and to prolong the life of the product.

To that end, there is a conventional image forming apparatus, as disclosed in Japanese Patent Application Laid open No. 2004-317865, adopting such speed control that the sheet conveying speed from the sheet feed portion up to the image forming portion is set faster than conveying speed in the image forming portion and the sheet conveying speed is decelerated before reaching the image forming portion. Then, according to such speed-increasing conveying control allows an enough inter-sheet distance to be assured in feeding a sheet and the inter-sheet distance to be shortened in forming an image.

Here, the conventional image forming apparatus holds many factors that disturb the sheet conveying timing. Such factors include how sheets are set within the sheet feeding cassette, a difference of frictional resistances of sheets, and a slip of the conveying roller while separating sheets for example. Such factors also include a phenomenon (referred to as 'entrainment' hereinafter) in which a succeeding sheet is delivered by a preceding sheet in a state in which a part of the succeeding sheet overlaps with the preceding sheet and a variation of driving system operation starting timing. Then, if the sheet conveying timing is disturbed as described above, there is a case when the succeeding sheet approaches the preceding sheet too much or delays too much. In such a case, it becomes unable to convey the sheet at predetermined timing to the image forming portion, thus causing jamming.

In order to prevent such disturbance, the sheet conveying speed is controlled such that a tolerance limit in a direction in which a sheet is fed late more than a predetermined timing and a direction in which a sheet is fed earlier than the predetermined timing fully covers an assumed range of variations of conveying timing. It is noted that the tolerance limit in the direction in which the sheet is fed late more than the predetermined timing will be referred to as a 'late arrival jam margin' hereinafter. Still further, the tolerance limit in the direction in which the sheet is fed quicker than the predetermined timing will be referred to as a 'quick arrival jam margin' hereinafter.

However, with the advance of late downsizing and cost-cut of an image forming apparatus, it is unable to assure enough late arrival jam margin and quick arrival jam margin only by the speed increasing conveyance control due to the following two reasons if the downsizing and cost-cut advance so much. The first reason is that a conveying distance from the sheet feeding portion to the image forming portion is shortened in the downsized image forming apparatus. While it is necessary to arrange such that a succeeding sheet catches ups a preceding sheet and a certain length of conveying distance is assured between the sheet feeding portion to the image forming portion to that end to conduct the speed increasing conveyance control, it is unable to assure the enough conveying distance if the downsizing advances.

The second reason is that many conveying rollers are driven by one and same driving source to realize the downsizing and cost-cut. While speeds for conveying the preceding sheet and the succeeding sheet are differentiated in the speed increasing conveyance control, the speeds can be differentiated only when a driving source of the rollers conveying the preceding sheet is different from a driving source of the rollers conveying the succeeding sheet. Therefore, if the many conveying rollers are driven by the one and same driving source, an area where speed increasing conveyance control can be conducted is very limited in the section from the sheet feeding portion to the image forming portion and the succeeding sheet may not be able to catch up the preceding sheet.

If the downsizing and cost-cut of the image forming apparatus thus advance, it is unable to assure an enough late arrival jam margin and a quick arrival jam margin. Therefore, it is necessary to shorten the jam margin in order to stably convey a sheet to the image forming portion.

Figure 17:
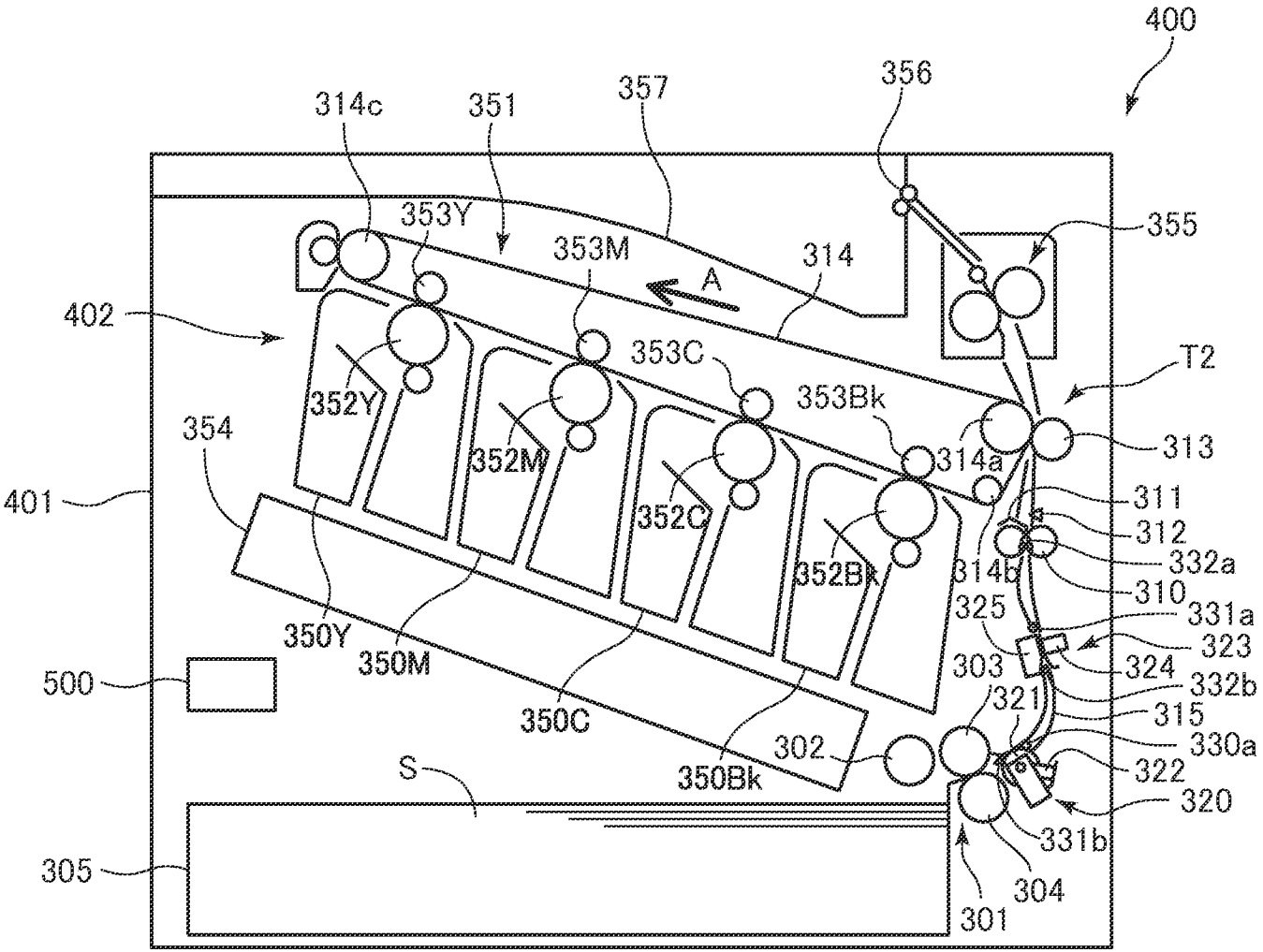
FIG. 17 is a schematic diagram showing a configuration of a laser printer, i.e., one exemplary image forming apparatus, including a sheet feeding apparatus of a fifth embodiment of the present invention.

A fifth embodiment of the present invention will be described below in detail with reference to the drawings. FIG. 17 illustrates a configuration of a laser printer 400, i.e., an exemplary image forming apparatus, including a sheet feeding apparatus of the fifth embodiment of the present invention. The laser printer 400 includes a body of the laser printer (referred to simply as a 'printer body' hereinafter) 401, an image forming portion 402 configured to form an image on a sheet, the sheet feeding apparatus 301 provided at an under part of the laser printer body 401 and configured to feed a sheet S, and a control portion 500 configured to control an image forming operation, a sheet feed operation, and a sheet conveying operation.

The image forming portion 402 includes a scanner unit 354 and four process cartridges 350 (350Y, 350M, 350C, and 350Bk) configured to form four toner images of yellow (Y), magenta (M), cyan (C), and black (Bk). The image forming portion 402 further includes an intermediate transfer unit 351 disposed above the process cartridge 350. Here, the respective process cartridges 350 includes photosensitive drums 352 (352Y, 352M, 352C, and 352Bk). The intermediate transfer unit 351 also includes an intermediate transfer belt 314 wrapped around a driving roller 314*a*, a tension roller 314*b*, and a driven roller 314*c*. The intermediate transfer unit 351 also includes primary transfer rollers 353 (353Y, 353M, 353C, and 353Bk) provided in an inner side of the intermediate transfer belt 314 and in contact with the intermediate transfer belt 314 at positions facing to photosensitive drums 352.

The intermediate transfer belt 314 is made of a film-like member, is disposed to be in contact with the respective photosensitive drums 352, and is rotated in a direction of an arrow A in FIG. 17 by the driving roller 314*a* driven by a driving portion not shown. Then, the respective color toner images having a negative polarity on the photosensitive drums are superimposed and transferred sequentially to the intermediate transfer belt 314 by positive transfer bias applied to the intermediate transfer belt 314 by the primary transfer rollers 353. Thus, a full-color image is formed on the intermediate transfer belt 314. It is noted that a secondary transfer roller 313 composing the secondary transfer portion T2 configured to transfer the full-color image formed on the intermediate transfer belt 314 to the sheet S is provided at a position facing to the driving roller 314*a* of the intermediate transfer unit 351. A fixing portion 355 is also disposed above the secondary transfer roller 313.

Next, the image forming operation of the laser printer 400 constructed as described above will be described. In response to a start of the image forming operation, the scanner unit 354 irradiates laser light not shown to the photosensitive drum 352 based image information sent from a personal computer or the like not shown to sequentially expose a surface of the photosensitive drum 352 homogeneously electrified with predetermined polarity and potential and to form an electrostatic latent image on the photosensitive drum 352. After that, this electrostatic latent image is developed by toner as a visualized toner image. The visualized toner images are superimposed and transferred to the intermediate transfer belt 314 by primary transfer bias applied to the primary transfer rollers 353. Thus, a full-color toner image is formed on the intermediate transfer belt 314.

Concurrently with this toner image forming operation, the sheet S stored in the sheet feeding cassette 305 is delivered by the sheet feeding apparatus 301. This sheet S is conveyed to the conveying roller 310. It is noted that the conveying roller 310 is provided with a registration shutter 311 configured to correct a skew of the sheet S. After correcting the skew of the sheet S by the registration shutter 311, the sheet S is conveyed to a secondary transfer portion T2. In the secondary transfer portion T2, the full-color toner image is then collectively transferred to the sheet S by a secondary transfer bias applied to a secondary transfer roller 313. Next, the sheet S on which the full-color toner image has been transferred is conveyed to a fixing portion 355. In the fixing portion 355, the respective color toners melt and are mixed by receiving heat and pressure and are fixed on the sheet S as a full-color image. After that, the sheet S on which the image has been fixed is discharged to a discharge tray 357 by a discharging roller pair 356 provided downstream of the fixing portion 355.

Figure 18:
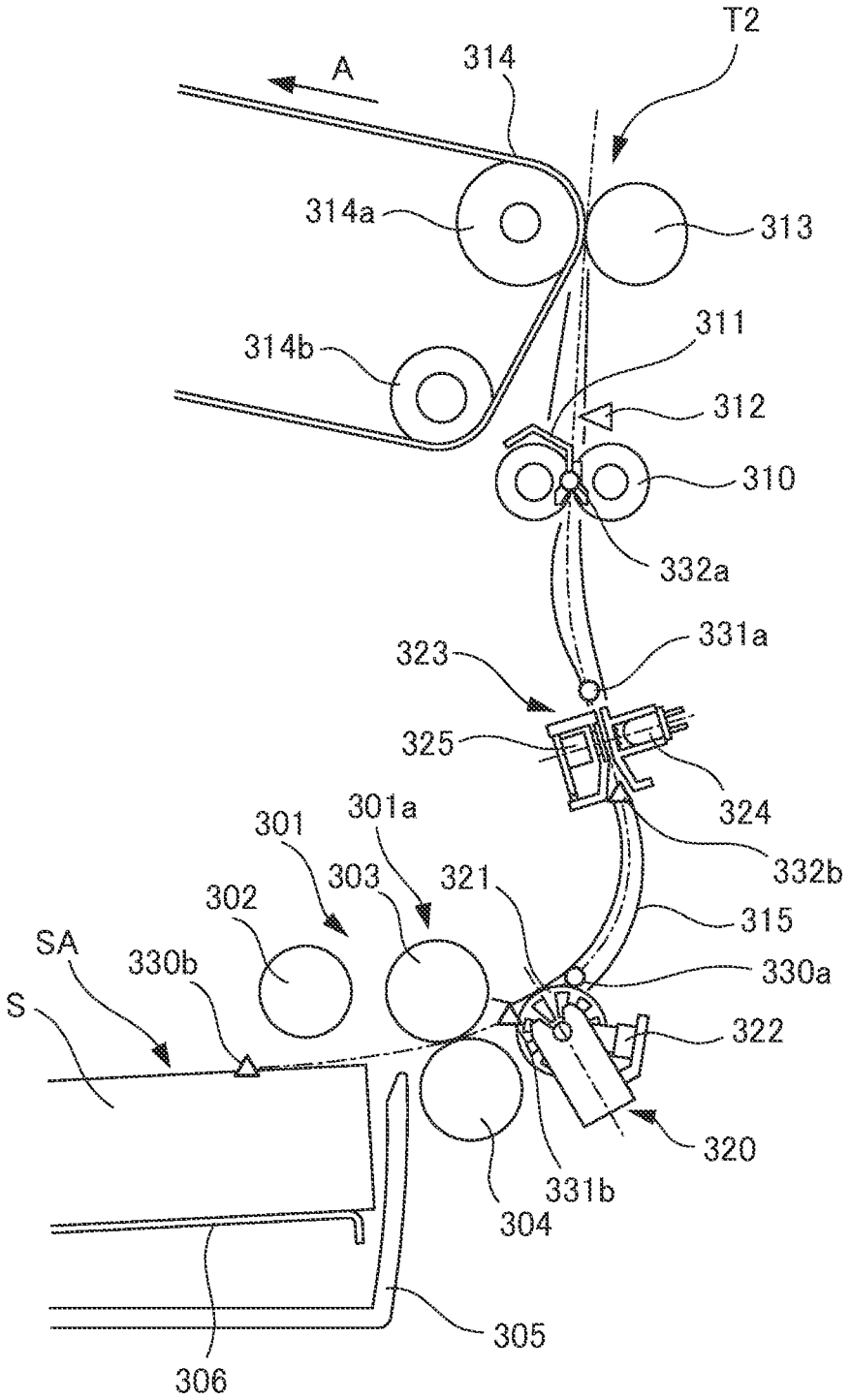
FIG. 18 is an enlarged view of a main part of a sheet feeding apparatus of the fifth embodiment of the present invention.

By the way, the sheet feeding apparatus 301 includes a pickup roller 302, i.e., a sheet feeding portion, for delivering the sheet S stacked and stored in the sheet feeding cassette 305, i.e., a sheet storing portion, as shown in FIG. 18. It is noted that in FIG. 18, the sheet feeding cassette 305 is provided with a lifter plate 306 to control such that a predetermined height of an upper surface of a sheet bundle SA is maintained by driving a lifting motor M2 based on a signal from a sheet surface detecting sensor 340 shown in FIG. 19.

The sheet feeding apparatus 301 also includes a separating and conveying roller 303 and a separating roller 304 in pressure contact with the separating and conveying roller 303 and composing a separating portion 301*a* together with the separating and conveying roller 303. The separating roller 304 is configured to separate a sheet S by rotating through a torque limiter not shown. The pickup roller 302 is provided such that it can be in contact with or be separated from the upper surface of the sheet bundle SA and separates from the upper surface of the sheet bundle when the picked up sheet S is passed to the separating and conveying roller 303.

Figure 19:
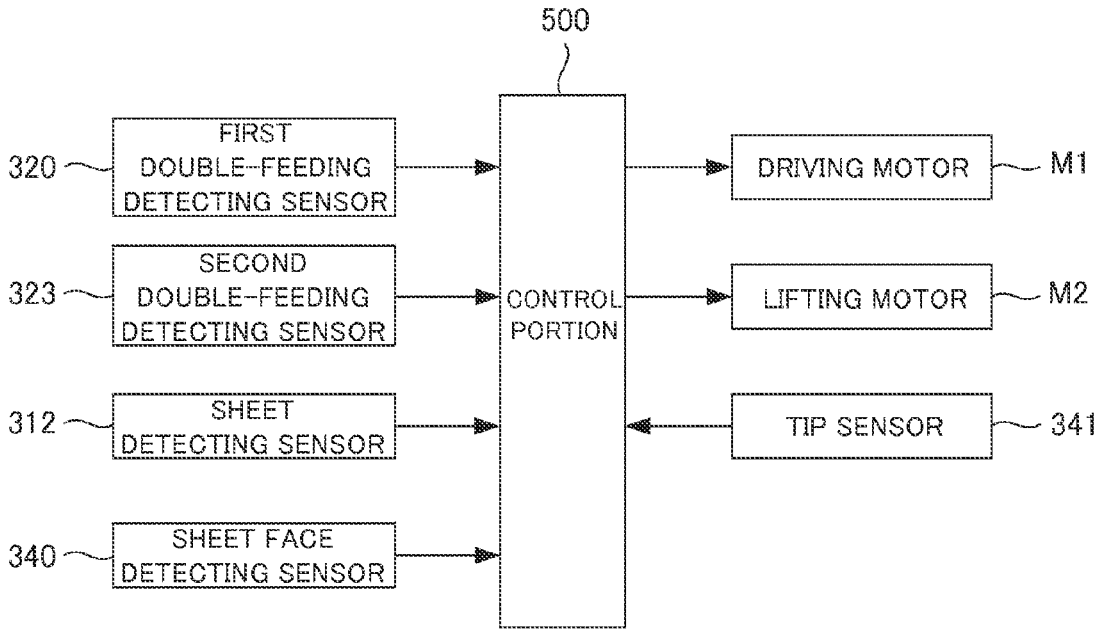
FIG. 19 is a control block diagram of the laser printer.

Here, in the present embodiment, the pickup roller 302, the separating and conveying roller 303, and the conveying roller 310, i.e., the sheet conveying portion, are rotationally driven by the driving motor M1, i.e., a common driving source shown in FIG. 19. It is noted that the pickup roller 302 and the separating and conveying roller 303 are linked with the driving motor M1 through a clutch and a drive train not shown, and the conveying roller 310 is linked with the driving motor M1 through a drive train not shown.

Still further, as shown in FIG. 18, first and second double-feeding detecting sensors 320 and 323, i.e., detecting portions configured to detect a succeeding sheet delivered by a predetermined amount by a preceding sheet, are provided between the separating and conveying roller 303 and the conveying roller 310. The first double-feeding detecting sensor 320, i.e., the first detecting portion, is provided on a sheet conveying path 315 between the pickup roller 302 and the conveying roller 310 and configured to detect that two or more sheets are present at a first detecting position on the sheet conveying path 315. The second double-feeding detecting sensor 323, i.e., the second detecting portion, is provided on the sheet conveying path 315 and configured to detect that two or more sheets are present at a second detecting position downstream in the sheet conveying direction of the first detecting position of the first double-feeding detecting sensor 320. It is noted that a phenomenon in which the succeeding sheet is fed downstream in the feed direction in a state in which a part thereof overlaps with a preceding sheet by friction force with preceding sheet while feeding the preceding sheet will be defined as 'entrainment' also in the following description.

Still further, a state in which the preceding sheet and the succeeding sheet overlap and are present on a way of the sheet conveying path 315 will be also defined as 'double feeding' or a double-feeding state' regardless whether or not the succeeding sheet entrained by the preceding sheet moves together with the preceding sheet. A phenomenon in which a front end of the succeeding sheet reaches to the conveying roller 310 and the succeeding sheet is continuously conveyed downstream together with the preceding sheet in the double-feeding state will be defined as an 'unavoidable double feeding' hereinafter. These phenomena will be expressed separately as described above in the following explanation.

The first double-feeding detecting sensor 320 includes a driven roller 321, i.e., an encoder (rotating body), having a plurality of slits in a radial direction and rotating such that an outer circumference thereof is lightly in contact with a surface on a separating roller side of the sheet S being conveyed. The first double-feeding detecting sensor 320 also includes a photo sensor (rotating amount detecting portion) 322 disposed at a position facing the plurality of slits of the driven roller 321 and configured to detect a rotation amount of the driven roller 321. Then, the first double-feeding detecting sensor 320 outputs consecutive rectangular waves (pulse signal) shown in FIG. 20A because the plurality of slits pass in sequence through an optical axis of the photo sensor 322 when the sheet moves and the driven roller 321 rotates following the sheet. Thus, the first double-feeding detecting sensor 320 composes a moving amount detecting portion detecting a moving amount of the sheet fed by the pickup roller 302.

Figures 20A, 20B, 20C:
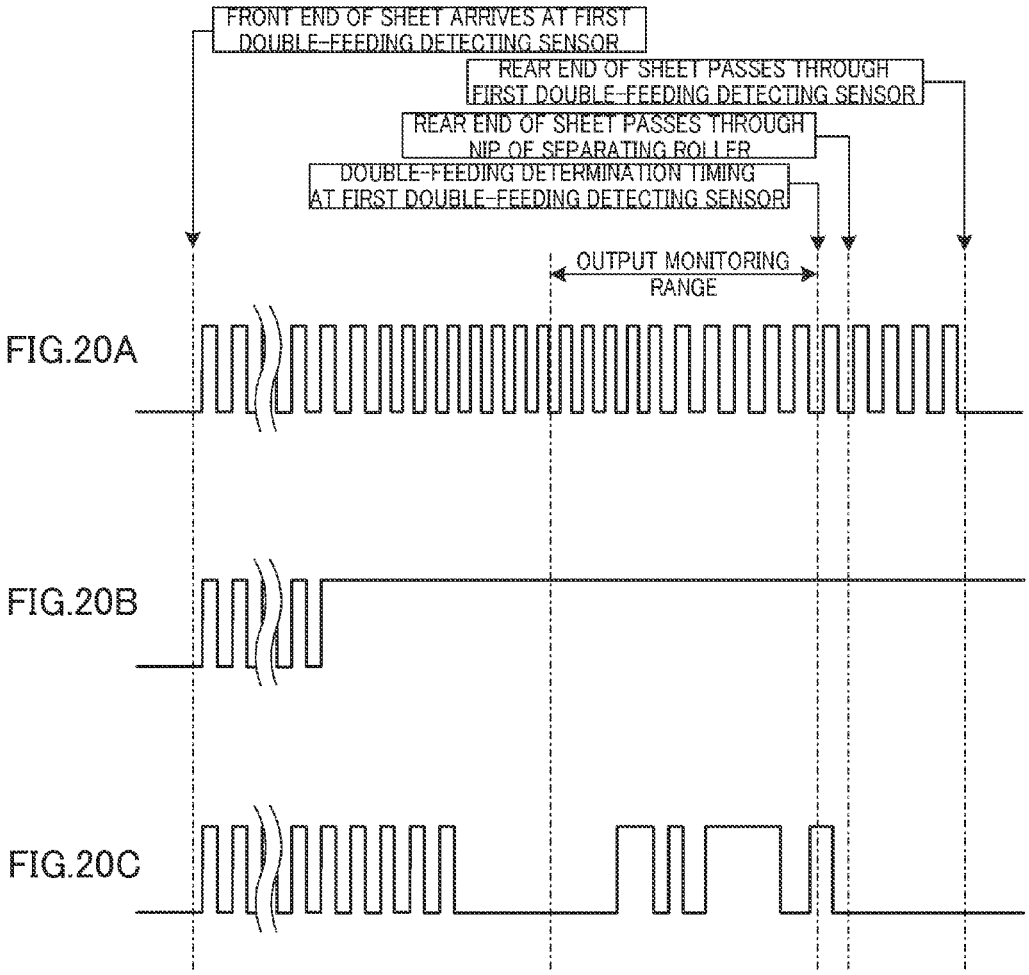
FIG. 20A illustrates an output waveform of a first double-feeding detecting sensor provided in the laser printer and showing a case when a sheet is normally fed.
FIG. 20B illustrates an output waveform of the first double-feeding detecting sensor provided in the laser printer and showing a case when an entrained succeeding sheet is stopped on a way.
FIG. 20C illustrates an output waveform of a first double-feeding detecting sensor provided in the laser printer and showing a case when an entrained succeeding sheet is fed while irregularly repeating moves and stops.
Figure 21A:
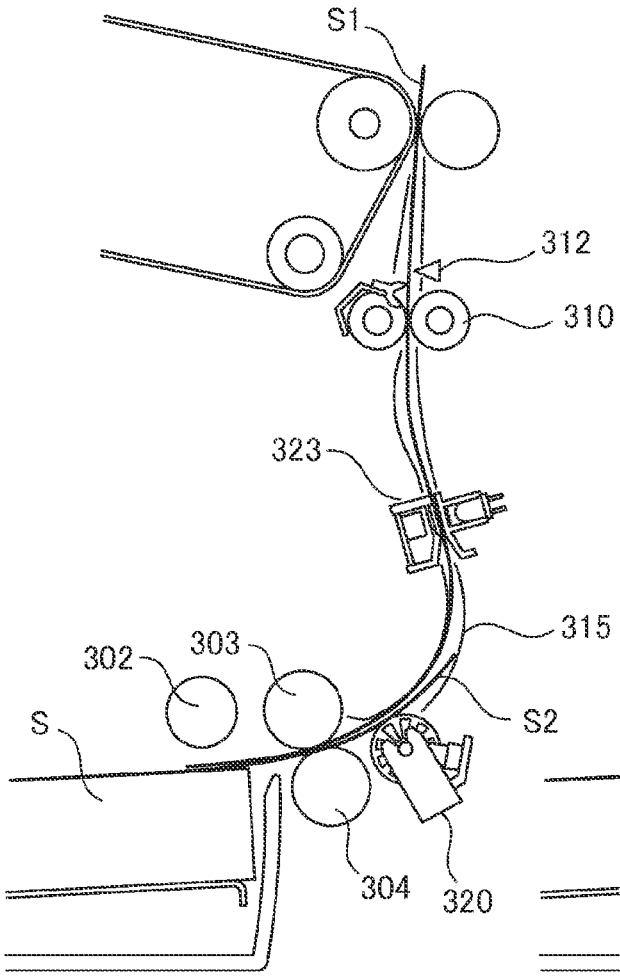
FIG. 21A illustrates a state of the sheet fed by the sheet feeding apparatus provided in the laser printer and shows a state in which the entrained sheet is stopped before reaching to a second double-feeding detecting sensor.

Meanwhile, there is a case when the succeeding sheet S2 entrained by the preceding sheet S1 being conveyed stops after passing through the driven roller 321, i.e., a rotating member, as shown in FIG. 21A. Because the driven roller 321 also stops to rotate in this case, an output waveform of the photo sensor 322, a rotation detecting portion, becomes unchanged during the conveyance of the preceding sheet as shown in FIG. 20B.

There is also a case when the succeeding sheet entrained by the preceding sheet during its conveyance advances while repeating moves and stops little by little. Differing from the normal conveyance, a rectangular wave whose frequency is long is outputted and periodicity of the rectangular waves is considerably disturbed in this case as shown in FIG. 20C. From the difference of these outputs, a control portion 500 discriminates whether the succeeding sheet is entrained to the position of the first double-feeding detecting sensor 320. In the present embodiment, the control portion 500 counts a number of outputted rectangular waves within an output monitoring range shown in FIG. 20C and discriminates whether a doubly fed sheet is present corresponding to a result of the count.

Figure 21B:
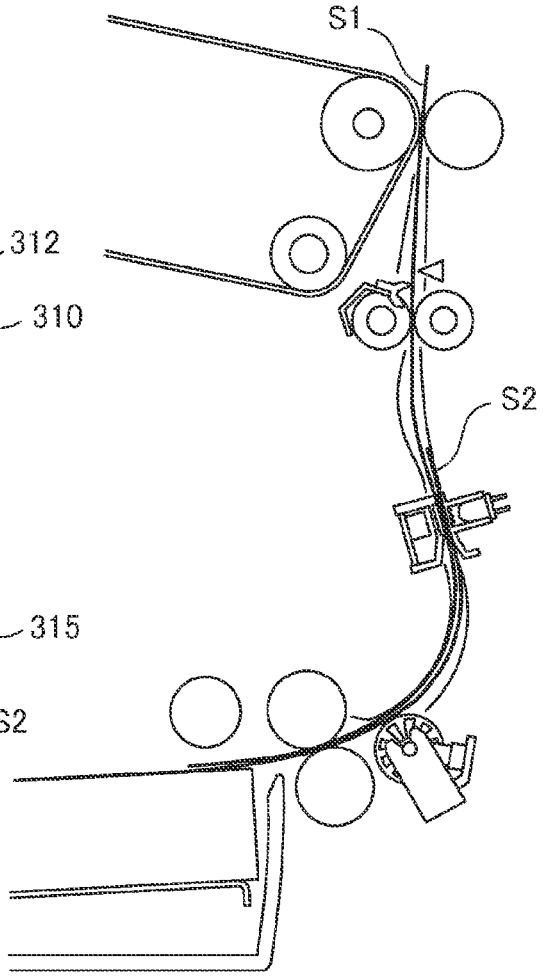
FIG. 21B illustrates a state of the sheet fed by the sheet feeding apparatus provided in the laser printer and shows a state in which the entrained sheet is stopped after reaching to the second double-feeding detecting sensor.

Meanwhile, the second double-feeding detecting sensor 323 includes a light emitting element (light projecting portion) 324 and a light receiving element (light receiving portion) 325 disposed so as to face with each other with the sheet conveying path 315 therebetween. The second double-feeding detecting sensor 323 is configured to discriminate a number of sheets present between the both elements 324 and 325 by measuring a light quantity reaching to the light receiving element 325 from the light emitting element 324 by transmitting through the sheets during the conveyance of the sheet. FIG. 22A shows output waveforms during the normal conveyance in which no succeeding sheet is entrained. FIG. 22B shows output waveforms in a case when the entrained succeeding sheet S2 arrives at the second double-feeding detecting sensor 323 during the conveyance of the preceding sheet S1 as shown in FIG. 21B. FIG. 22C shows output waveforms of a case when the preceding sheet S1 and the succeeding sheet S2 are doubly conveyed while completely keeping their shapes. It is noted that in the present embodiment, the second double-feeding detecting sensor 323 functions also as a sensor discriminating a type of the sheet being conveyed.

By the way, as shown in FIG. 18, disposed in a vicinity downstream of the conveying roller 310 is a sheet detecting sensor 312 for feeding the sheet to the secondary transfer portion T2 at a predetermined timing or, more specifically, at a timing coincident with a front end of a toner image on the intermediate transfer belt 314 Then, based on a sheet detection timing of the sheet detecting sensor 312, the control portion 500 controls the driving motor M1 so as to be able to supply the sheet to the secondary transfer portion T2 at the predetermined timing and at a same speed with the rotating speed of the intermediate transfer belt 314 (referred to as a 'processing speed' hereinafter).

At this time, in order to supply the sheet to the secondary transfer portion T2 at the predetermined timing and at the processing speed, it is necessary to suppress variation of timing at which the sheet arrives at the sheet detecting sensor 312 into a range in which the variation can be absorbed by controlling speed of the conveying roller 310. Here, as a factor that quickens the arrival timing, there is a case when the succeeding sheet is entrained during a feed operation of the preceding sheet and a front end of the succeeding sheet at a moment of time when a feed operation of the succeeding sheet is started is located downstream in the feed direction of a front end position of a sheet bundle stored in the sheet feeding cassette 305. Still further, there is a case when the sheet passes through a shortest course of the sheet conveying path 315 for example.

A tolerable quick arrival side limit will be defined as a 'quick arrival limit' hereinafter. Then, if the succeeding sheet arrives at the sheet detecting sensor 312 earlier than a timing of the quick arrival limit, it becomes unable to reduce the sheet conveying speed to the processing speed until sheet arrives at the secondary transfer portion T2. Still further, if the deceleration cannot be made in time, the succeeding sheet overlaps with the preceding sheet and the sheet detecting sensor 312 cannot recognize an inter-sheet interval between the succeeding sheet and the preceding sheet. In this case, the operation of the laser printer 400 is stopped by assuming that quick arrival jamming or a staying jam has occurred.

Meanwhile the factors that delay the arrival timing to the sheet detecting sensor 312 include a drop of conveyance efficiency of the separating and conveying roller 303 caused by a sheet separating friction of the separating roller 304 and conveyance resistance receiving from the sheet conveying path 315 and a drop of conveying speed accompanying with wear of durability of rollers. Still further, the factors include a positional shift of the sheet set within the sheet feeding cassette 305 and a case when the sheet passes through a most roundabout course of the sheet conveying path 315 for example. A tolerable arrival late side limit will be defined as a 'late arrival limit' hereinafter. Then, if the sheet arrives at the sheet detecting sensor 312 later than the late arrival limit timing, it becomes unable to conveying the sheet to the secondary transfer portion T2 at the predetermined timing. In this case, the operation of the laser printer is stopped by assuming that late arrival jamming has occurred.

Here, the present embodiment is arranged to be able to supply the sheet to the secondary transfer portion T2 at the predetermined timing even if the sheet arrives at the sheet detecting sensor 312 quicker than the quick arrival limit timing or later than the late arrival limit timing. Next, the sheet feeding and conveying controls in the laser printer 400 will be described with reference to timing charts shown in FIGS. 23 and 24.

Figure 23:
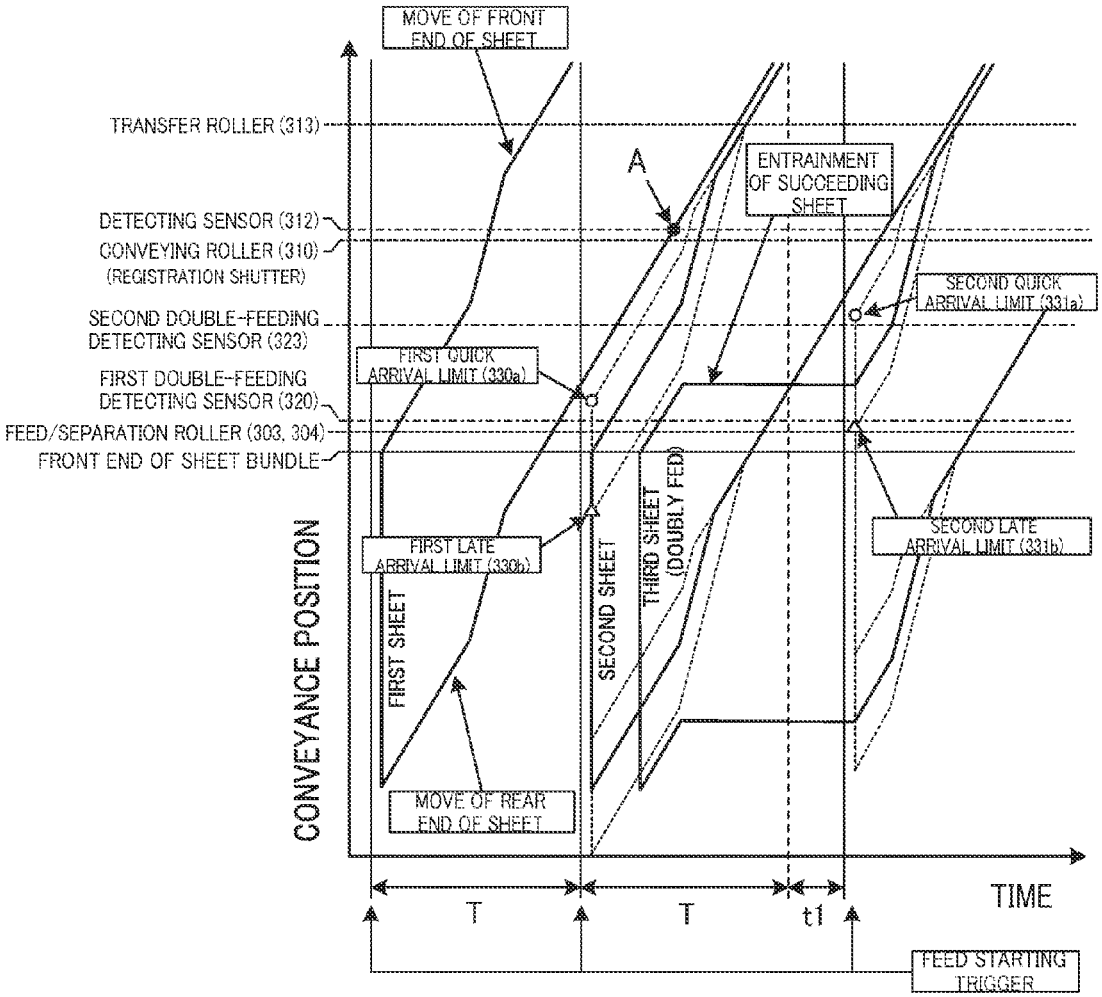
FIG. 23 is a first timing chart illustrating sheet feeding and conveying controls of the laser printer.
Figure 24:
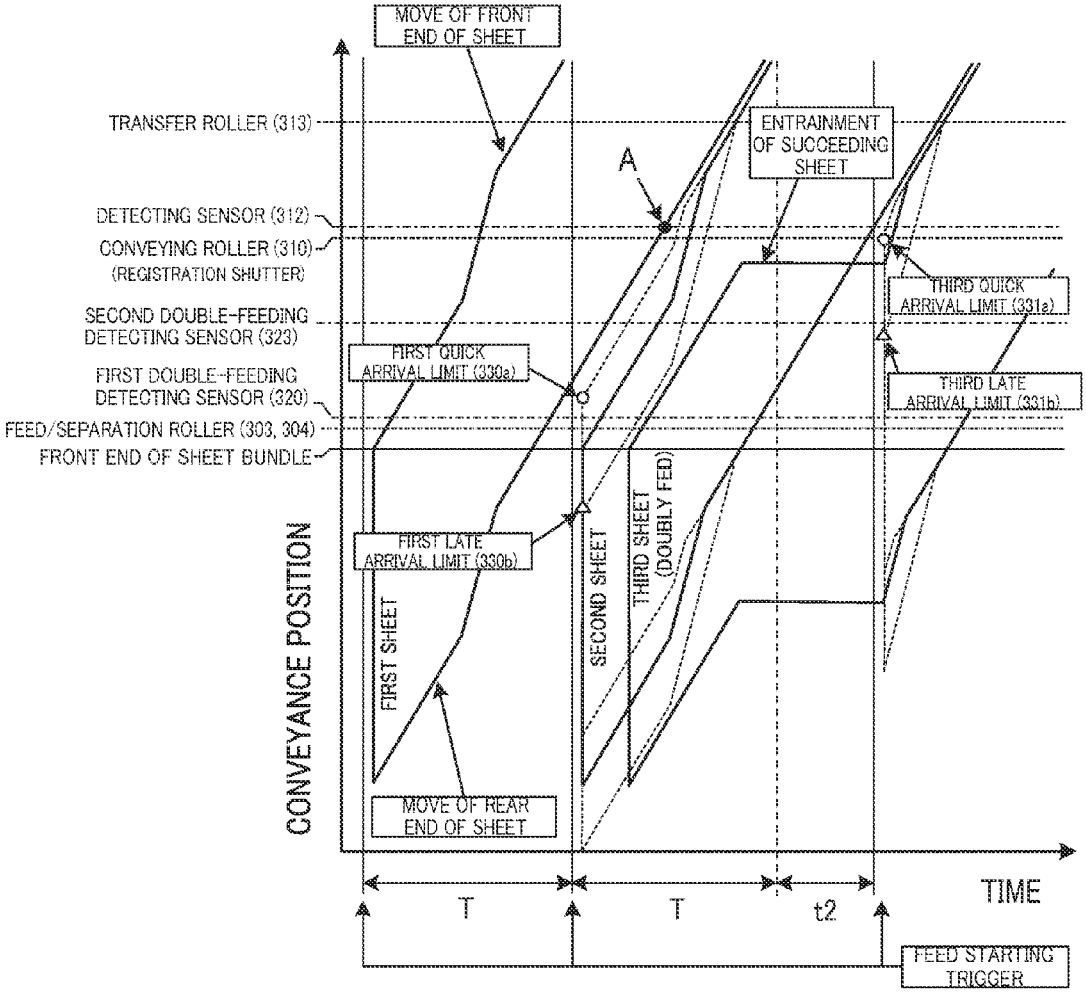
FIG. 24 is a second timing chart illustrating the sheet feeding and conveying controls of the laser printer.

It is noted that in FIGS. 23 and 24, an axis of abscissa represents time and an axis of ordinate represents a sheet conveyed position, and moves of the fed sheets how they are conveyed are plotted by moves of front and rear end positions of the sheets. An inclination of each line in the graph represents sheet conveying speed at each moment of time and a part where the inclination is horizontal means that the move of the sheet is stopping. Still further, the present embodiment adopts the speed increasing conveyance control and is configured to change the sheet conveying speed when the sheet passes through the secondary transfer roller 313 (the secondary transfer portion T2) to a first speed and to a second speed faster than the first speed.

At first, among the moves of the three sheet shown in FIG. 23, the moves of the first and second sheets will be explained (the same applies also to first and second sheets in FIG. 24). FIGS. 23 and 24 show the moves of the sheets fed from the sheet feeding cassette 305 with a predetermined interval T during a consecutive sheet feeding operation. In the present embodiment, because the rollers from the separating and conveying roller 303 to the conveying roller 310 are driven by the same driving motor M1 as described above, the succeeding sheet is required to be conveyed at the first speed until when the rear end of the preceding sheet passes through the conveying roller 310.

Then, when the second double-feeding detecting sensor 323 detects the preceding sheet and outputs a detection signal, the control portion 500 increases the speed to the second speed, and when the sheet detecting sensor 312 detects the preceding sheet, the control portion 500 reduces the speed to the first speed. Then, when the control portion 500 detects that the rear end of the preceding sheet being conveyed with the first speed reduced based on the detection signal inputted from the sheet detecting sensor 312 has passed through the sheet detecting sensor 312 at point A in FIG. 23, the control portion 500 increases, by being triggered with that, the conveying speed of the succeeding sheet to the second speed Soon after that, when the front end of the succeeding sheet arrives at the sheet detecting sensor 312, the control portion 500 determines, corresponding to the arrival timing of the front end of the succeeding sheet, a timing for returning the conveying speed of the succeeding sheet to the first speed. Thereby, the succeeding sheet is adjusted to be conveyed to the secondary transfer portion T2 at the process speed and at the predetermined timing. Here, the quick arrival limit and the late arrival limit described above are shown at positions 330*a* and 330*b* in FIGS. 23 and 24 as allowable position of the front end of the sheet at a sheet feeding starting point of time.

The quick arrival limit 330*a* and the late arrival limit 330*b* in the case when the sheet feed operation is started at the normal timing will be defined respectively as a first quick arrival limit and a first late arrival limit. It is noted that the control portion 500 judges whether the sheet is located at the quick arrival limit or the late arrival limit by a time until when a front end sensor 341 shown in FIG. 19 disposed upstream of the first double-feeding detecting sensor 320 detects the sheet since the start of the feed of the sheet. Dot lines of operation charts of second sheet in FIGS. 23 and 24 show conveyance controls made in the cases when the control portion 500 judges that the front end of the sheet to be fed is located at the first quick arrival limit and at the first late arrival limit. The control explained so far is a control generally used.

By the way, there is a case when the succeeding sheet is entrained by the preceding sheet and exceeds the first quick arrival limit at the sheet feed starting point of time for example. In this case, the succeeding sheet is conveyed to the secondary transfer portion T2 while overlapping with the preceding sheet, so that the operation has to be stopped as jamming by the conventional control.

Then, in the present embodiment, it is judged whether the front end of the succeeding sheet has arrived at the first double-feeding detecting sensor 320 or the second double-feeding detecting sensor 323 at a point of time of starting to feed the succeeding sheet. If it is judged that the front end of the succeeding sheet has arrived at the first double-feeding detecting sensor 320 or the second double-feeding detecting sensor 323, the control is made to delay to start to feed a further succeeding sheet. For instance, if the front end of the succeeding sheet has arrived at the first double-feeding detecting sensor 320, the control portion 500 delays the start of the feed of the sheet by a first delay time t1, and if the succeeding sheet has arrived at the second double-feeding detecting sensor 323, the control portion 500 delays the start of the feed of the sheet by a second delay time t2. It is possible to control the conveyance of the sheet stably without stopping as jamming even if the sheet exceeds the first quick arrival limit by delaying the start of the feed of the sheet by the delay times t1 and t2 set corresponding to the front end position of the succeeding sheet.

That is, in the case of feeding sheets consecutively, the control portion 500 changes the timing for starting the feed operation of the succeeding sheet (n+1th sheet) based on the detection results of the first and second double-feeding detecting sensors 320 and 323 when the preceding sheet (nth sheet) is fed. Specifically, the control portion 500 starts the feed operation of the succeeding sheet after an elapse of time x since the feed operation of the preceding sheet if the first and second double-feeding detecting sensors 320 and 323 do not detect two or more sheets when the preceding sheet has been fed.

The control portion 500 also starts the feed operation of the succeeding sheet after an elapse of the first delay time t1 since the start of the feed operation of the preceding sheet when the first double-feeding detecting sensor 320 has only detected two more sheets when the preceding sheet has been fed. That is, the control portion 500 starts the feed operation of the succeeding sheet after the elapse of a time y which is longer than the time x. Still further, when the first and second double-feeding detecting sensors 320 and 323 detect two more sheets when the preceding sheet has been fed, the control portion 500 starts the feed operation of the succeeding sheet after an elapse of the second delay time t2 since the start of the feed operation of the preceding sheet. That is, the control portion 500 starts the feed operation of the succeeding sheet after an elapse of a time z which is longer than the time y.

Next, the control on the conveyance of the sheets based on the detection results of the first and second double-feeding detecting sensors 320 and 323 of the present embodiment as described above will be described. It is noted that in the following description, the quick arrival limit and the late arrival limit in a case in which the sheet feed starting timing is delayed by the first delay time t1 will be defined as a second quick arrival limit and a second late arrival limit, respectively. The second quick arrival limit and the second late arrival limit are what the first quick arrival limit and the first late arrival limit are shifted downstream in the conveying direction by t1 x conveying speed and are indicated at positions 331*a* and 331*b* in FIGS. 18 and 23.

In the same manner, the quick arrival limit and the late arrival limit in a case in which the sheet feed starting timing is delayed by the second delay time t2 will be defined as a third quick arrival limit and a third late arrival limit and are indicated respectively at positions 332*a* and 332*b* in FIGS. 18 and 24. It is noted that while the third quick arrival limit 332*a* can be disposed downstream in the conveying direction of the conveying roller 310 in terms of control timing, a point just before the front end of the succeeding sheet enters the nip of the conveying roller 310 becomes a limit position in fact, so that the nip position of the conveying roller 310 is expressed as the third quick arrival limit 332*a*.

As shown in FIG. 18, the first double-feeding detecting sensor 320 is disposed upstream in the sheet conveying direction of the first quick arrival limit 330*a* and downstream in the sheet conveying direction of the second late arrival limit 331*b*. Still further, the second double-feeding detecting sensor 323 is disposed upstream in the sheet conveying direction of the second quick arrival limit 331*a* and downstream in the sheet conveying direction of the third late arrival limit 332*b*.

The control portion 500 judges the position of the front end of the succeeding sheet corresponding to the outputs of the first and second double-feeding detecting sensors 320 and 323 at the moment of time of starting the feed operation of the succeeding sheet. For instance, there is a case when the first double-feeding detecting sensor 320 indicates the 'double feeding condition' (no change in the output waveform of the photo sensor) and the second double-feeding detecting sensor 323 indicates the 'non-double feeding condition' (a quantity of transmitted light detected by the light receiving element is one sheet). It is noted that this is a state shown in FIG. 21A and the second sheet in FIG. 23 corresponds to the preceding sheet S1 and the third sheet corresponds to the succeeding sheet S2.

In this case, the control portion 500 judges that the front end of the succeeding sheet S2 is entrained to a position between the first double-feeding detecting sensor 320 and the second double-feeding detecting sensor 323. Then, the control portion 500 delays the starting timing of the feed operation of the succeeding sheet S2 by the predetermined first delay time t1 with respect to the normal sheet feeding interval T as shown in FIG. 23.

When the first and second double-feeding detecting sensors 320 and 323 output as described above, it is possible to conveyed the succeeding sheet S2 without stopping as jamming by delaying the starting timing of the sheet feed operation by the first delay time t1. It is noted that the conveyance controls in cases when the front end of the succeeding sheet is located at the second quick arrival limit 331*a* and is located at the second late arrival limit 331*b* are made as indicated by dot lines in the operation chart of the third sheet in FIG. 23.

There is also a case when the both first and second double-feeding detecting sensors 320 and 323 indicate the 'double-feeding condition' at the moment of time of starting the feed operation of the succeeding sheet S2. This is a state shown in FIG. 21B, and the second sheet in FIG. 24 corresponds to the preceding sheet S1 and the third sheet corresponds to the succeeding sheet S2. In this case, the control portion 500 judges that the front end of the succeeding sheet is entrained to a position between the second double-feeding detecting sensor 323 and the conveying roller 310. Then, the control portion 500 delays the starting timing of the feed operation of the succeeding sheet by the predetermined second delay time t2 with respect to the normal sheet feeding interval T as shown in FIG. 24. That is, in the present embodiment, the feed starting timing of the next sheet is delayed in a case when a signal is inputted from the second double-feeding detecting sensor 323 downstream in the sheet conveying direction as compared to a case when a signal is inputted from the first double-feeding detecting sensor 320 upstream in the sheet conveying direction.

When the first and second double-feeding detecting sensors 320 and 323 thus output signals in the above-mentioned combination, it is possible to convey the succeeding sheet S2 without stopping as jamming by delaying the sheet feeding starting timing by the second delay time t2. It is noted that the conveyance controls in cases when the front end of the succeeding sheet is located at the third quick arrival limit 332*a* and is located at the third late arrival limit 332*b* are made as indicated by dot lines in the operation chart of the third sheet in FIG. 24.

Still further, if the front end of the succeeding sheet S2 has arrived at the conveying roller 310 (the third quick arrival limit 332*a*) by being entrained by the preceding sheet, the succeeding sheet is conveyed to the secondary transfer roller 313 together with the preceding sheet while being doubly fed (unavoidable double-feeding). At this time, while the second double-feeding detecting sensor 323 which is configured to discriminate the double feeding by thickness information of the sheet indicates the 'double feeding condition' (condition in which the quantity of transmitted light is reduced to that of two sheets), the first double-feeding detecting sensor 320 which is configured to discriminate the double feeding by the move information of the sheet surface indicates the 'non-double feeding condition' (continuous rectangular wave).

This combination of the output waveforms are the same with the output waveforms outputted until when the front end of the succeeding sheet entrained by the preceding sheet stops after passing through the second double-feeding detecting sensor 323. However, a number of rectangular waves outputted by the first double-feeding detecting sensor 320 is theoretically substantially constant in the moving distance until when the front end of the succeeding sheet arrives at the conveying roller 310 after passing through the second double-feeding detecting sensor 323. Therefore, it is possible to discriminate whether or not the succeeding sheet has arrived at the conveying roller 310 by counting the number of rectangular waves of the first double-feeding detecting sensor 320 outputted on and after when the front end of the succeeding sheet has arrived at the second double-feeding detecting sensor 323. In the present embodiment, if the result of the count exceeds a predetermined number, the control portion 500 judges that 'unavoidable double feeding has occurred' and instantly stops the operation of the laser printer by assuming as 'double-feeding error'.

As described above, in the present embodiment, the control is made to delay the feed starting timing of the succeeding sheet when the detection signals detecting the entrained succeeding sheet are inputted from the first and second double-feeding detecting sensors 320 and 323. In other words, the control is made to change the timing for starting to feed the n+1th sheet based on the detection results of the first and second double-feeding detecting sensors 320 and 323 when the nth sheet has been fed. This arrangement makes it possible to stably convey the sheet to the image forming portion 402 without reducing the jam margin.

It is noted that in the present embodiment, the detecting portion of a type determining whether or not double feeding is present by detecting the moving state of the sheet surface is adapted as the first double-feeding detecting sensor 320. That is, either one of the first and second double-feeding detecting sensors 320 and 323 is used as a move detecting portion detecting moves of the sheet. However, a detecting portion of a type of discriminating double feeding by thickness information of the sheet similar to the second double-feeding detecting sensor 323 may be used as the first double-feeding detecting sensor 320. Then, in a case when the detecting portion of such type is used, it is possible to detect an occurrence of double feeding accurately even if the succeeding sheet is entrained by any timing.

Still further, the laser printer of the present embodiment adopts the configuration of not rotationally driving the separating roller 304 in a direction of pushing back a doubly fed sheet to the sheet feeding cassette 305. In this configuration, the entrained succeeding sheet passing through the separating roller 304 will not be returned upstream in the sheet conveying direction after passing through the separating roller 304. Therefore, it is possible to discriminate double feeding of the sheet by the configuration of the first double-feeding detecting sensor 320 (the combination of the driven roller 321 having the slits and the photo sensor 322) described above.

In a case when a retard roller capable of rotating in a direction of returning a sheet to the sheet feeding cassette 305 is used instead of the separating roller 304, however, a continuous rectangular wave is outputted also during when the succeeding sheet is returned, so that it is difficult to discriminate an entrained condition of the succeeding sheet. Then, in the case when the retard roller is used, it is possible to discriminate double feeding accurately by adopting a sensor capable of detecting a moving direction in addition to the sensors detecting the move and stoppage of the sheet.

For one example, there is a method of using a sensor whose output changes not only to two values but also to three or more values when the driven roller rotates. If an arrangement is made such the sensor output changes to three values of Low, Mid, and Hi, it is possible to accurately discriminate the state of the succeeding sheet by designing such that the values are outputted in a sequence of Low, Mid, and Hi when the driven roller normally rotates and in a sequence of Low, Hi, and Mid when the driven roller reversely rotates. It is noted that as the detecting portion capable of detecting the moving state of the sheet, there are generally known a method of using a laser Doppler type sensor or a light receiving element capable of recognizing images of surface conditions of the sheets. The advantageous effects of the present invention may be obtained by adopting any methods.

<Sixth Embodiment>

By the way, while the conveyance control using the two double-feeding detecting sensors has been explained in the embodiments described above, the present invention is not limited to that configuration and the conveyance control can be made by using one double-feeding detecting sensor. Then, a sixth embodiment of the present invention arranged to make the conveyance control by using one double-feeding detecting sensor as described above will be explained.

Figure 25:
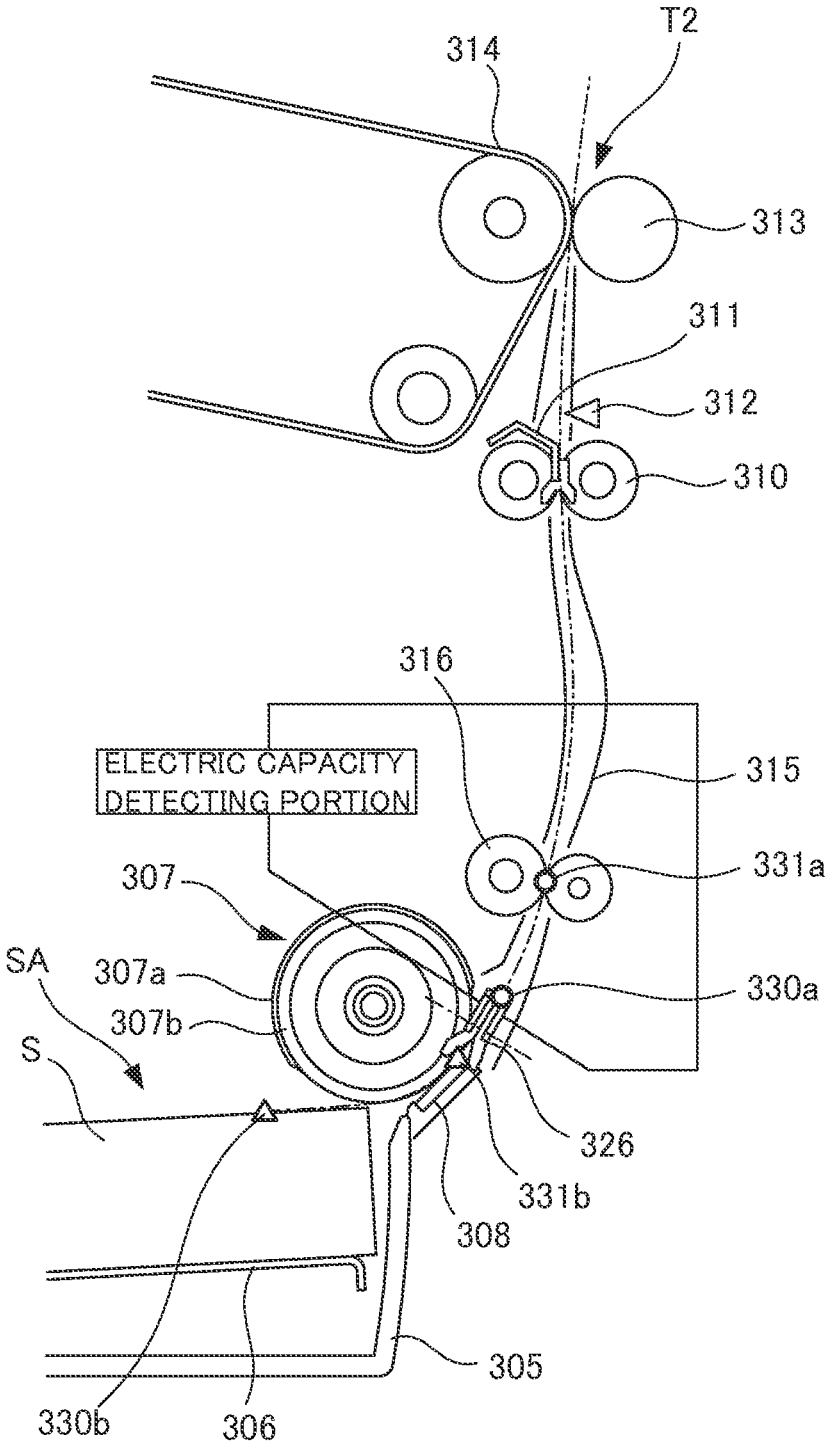
FIG. 25 is an enlarged view of a main part of a sheet feeding apparatus of an image forming apparatus of a sixth embodiment of the present invention.

FIG. 25 is an enlarged view of a main part of a sheet feeding apparatus of an image forming apparatus of the present embodiment. It is noted that in FIG. 25, the same reference numerals with those in FIG. 18 denote the same or corresponding parts. In FIG. 25, the sheet feeding apparatus 301 includes a sheet feeding roller 307 composed of a semicircular rubber portion 307*a* whose circumference is partly cut away and auxiliary rollers 307*b* disposed on both sides of the rubber portion 307*a*, a separating pad 308 in pressure contact with the sheet feeding roller 307, and a pull-out roller 316 provided along the sheet conveying path 315 from the sheet feeding roller 307 to the secondary transfer roller 313 where a toner image is transferred to a sheet. It is noted that the sheet feeding roller 307, the pull-out roller 316, and the conveying roller 310 are drived by the same and one driving motor M1. It is noted that the sheet feeding roller 307 is configured to be driven with a period of one rotation by a solenoid and a chipped tooth gear not shown and picks up a sheet S in the sheet feeding cassette 305 and feed to the pull-out roller 316 during when it rotates.

A double-feeding detecting sensor 326 configured to detect double feeding of sheets is disposed between the sheet feeding roller 307 and the pull-out roller 316. The double-feeding detecting sensor 326 includes an electrical capacitance detection portion composed of a pair of clamping members clamping a sheet with light pressure and a pair of planar electrodes provided on both sides of the clamp members and an electrical capacitance measuring circuit not shown and configured to measure changes of electrical capacitance between the planar electrodes. If the sheet S enters such double-feeding detecting sensor 326, a distance between the pair of planar electrodes changes and along with that, values of the electrical capacitance measured by the electrical capacitance measuring circuit change. Then, the control portion 500 detects how many sheets are present at the position of the double-feeding detecting sensor 326 corresponding to its variation.

Figure 26:
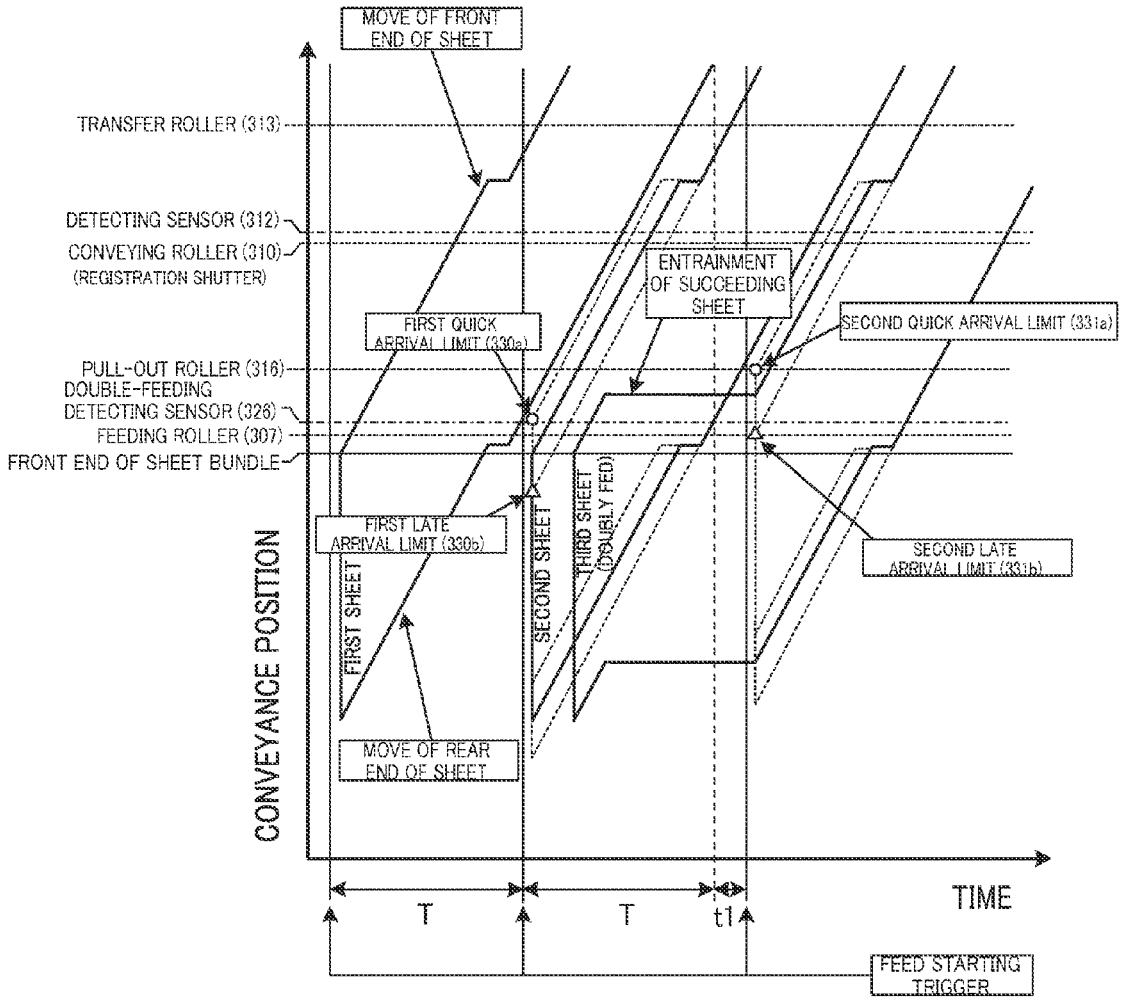
FIG. 26 is a timing chart illustrating sheet feeding and conveying controls of the image forming apparatus.

Next, the sheet feeding and conveyance control of the present embodiment will be explained with reference to a timing chart of the conveyance control shown in FIG. 26. It is noted that a quick arrival limit and a late arrival limit when a sheet is fed at the normal sheet feeding intervals will be defined as a first quick arrival limit and a first late arrival limit in the same manner with the fifth embodiment and are indicated by positions 330*a* and 330*b* in FIG. 25. Still further, the sheet feeding roller 307, the pull-out roller 316, and the conveying roller 310 are driven with a conveying speed substantially equal to a speed of the sheet passing through the secondary transfer portion T2.

Here, variations of the sheet conveying timing from the first quick arrival limit 330*a* to the first late arrival limit 330*b* are absorbed by adjusting the timing by temporarily stopping before the sheet enters the secondary transfer portion T2 corresponding to a timing when the sheet arrives at the sheet detecting sensor 312. This is shown by a dot line shown in the operation chart of a second sheet in FIG. 26. The control of the stop time is a method for absorbing the variation of the conveying timings generally performed since the past.

By the way, there is a case when the succeeding sheet is entrained by the preceding sheet and exceeds the first quick arrival limit 330*a* at the sheet feed starting point of time for example. In this case, the succeeding sheet is conveyed to the secondary transfer portion T2 while overlapping with the preceding sheet, so that the operation has to be stopped as jamming by the conventional control.

Then, in the present embodiment, if the front end of the succeeding sheet has passed through the double-feeding detecting sensor 326 at the point of time of starting to feed the succeeding sheet, a control of delaying the start of the feed of the sheet by a predetermined delay time t1 is made. It is then possible to control the conveyance of the sheet stably without stopping as jamming by delaying the start of the feed of the sheet even if the front end of the succeeding sheet exceeds the double-feeding detecting sensor 326.

It is noted that in the present embodiment, the quick arrival limit and the late arrival limit in a case in which the sheet feed starting timing is delayed by the first delay time t1 will be defined as a second quick arrival limit and a second late arrival limit, respectively. The second quick arrival limit and the second late arrival limit are what the first quick arrival limit and the first late arrival limit are shifted downstream in the conveying direction by t1 x conveying speed and are indicated respectively at positions 331*a* and 331*b* in FIGS. 25 and 26.

It is noted that while the second quick arrival limit 331*a* can be disposed downstream in the conveying direction of the pull-out roller 316 in terms of control timing, a point just before the front end of the succeeding sheet enters the nip of the pull-out roller 316 becomes a limit position in fact, so that the nip position of the pull-out roller 316 is expressed as the second quick arrival limit 331*a*. Still further, the double-feeding detecting sensor 326 is disposed upstream of the first quick arrival limit 330*a* and downstream of the second late arrival limit 331*b*.

The control portion 500 judges the position of the front end of the succeeding sheet corresponding to the outputs of the double-feeding detecting sensors 326 at the moment of time of starting the feed operation of the succeeding sheet. Then, if the control portion 500 judges that the front end of the succeeding sheet has been entrained to a position of the double-feeding detecting sensor 326, the control portion 500 delays the starting timing of the feed operation by the predetermined delay time t1 with respect to the normal timing. That is, in the case when the front end of the succeeding sheet is entrained to a position between the double-feeding detecting sensor 326 and the pull-out roller 316, the sheet feeding starting timing is delayed by the predetermined time t1. Then, it is possible to control the conveyance of the sheet stably without stopping as jamming by delaying the sheet feeding starting timing corresponding to the front end position of the succeeding sheet.

As described above, in the present embodiment, when the detection signal detecting the entrained succeeding sheet is inputted from the double-feeding detecting sensor 326, the control is made to delay the feed starting timing of the succeeding sheet. This arrangement makes it possible to stably convey the sheet to the image forming portion 402 without reducing the jam margin. As a result, it is possible to achieve both the high feeding and conveyance stability of the sheet and the formation of images at small inter-sheet intervals.

By the way, while the sheet feeding apparatus is configured to delay the feed starting timing of a next sheet by a predetermined time stepwise corresponding to the position to which the succeeding sheet has been entrained in the fifth and sixth embodiments, the present invention is not limited to such configuration. For instance, it is possible to configure such that a distance by which the succeeding sheet has been entrained is calculated and to start a feed operation of a next sheet by an optimum delay time corresponding to the entrained distance.

<Seventh Embodiment>

Figure 27:
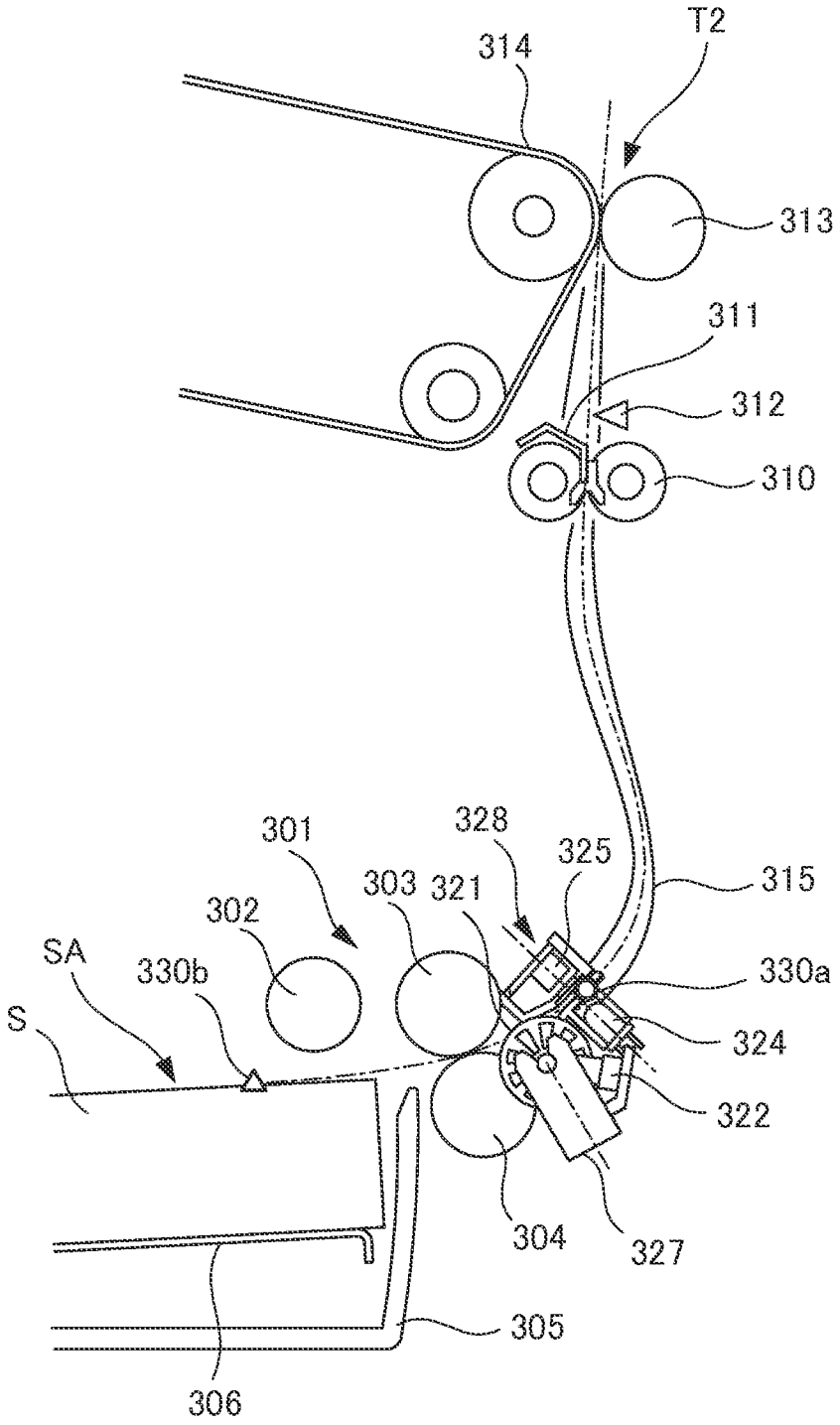
FIG. 27 is an enlarged view of a main part of a sheet feeding apparatus of an image forming apparatus of a seventh embodiment of the present invention.

Next, a seventh embodiment of the present invention arranged to start a feed operation of a next sheet at a delay time corresponding to the entrained distance of the succeeding sheet as described above will be described. FIG. 27 is an enlarged view of a main part of a sheet feeding apparatus of an image forming apparatus of the present embodiment. It is noted that in FIG. 27, the same reference numerals with those described in FIG. 18 denote the same or corresponding parts. It is noted that in the present embodiment, the speed increasing conveyance control using two conveying speeds is adopted in the same manner with the fifth embodiment described above.

In FIG. 27, the sheet feeding apparatus 301 includes a sheet movement detecting sensor 327 provided downstream of a nip between a separating and conveying roller 303 and a separating roller 304 and a sheet thickness detecting sensor 328 disposed in a vicinity of downstream of the sheet movement detecting sensor 327. It is noted that the sheet movement detecting sensor 327 is a sensor having the same configuration with the first double-feeding detecting sensor of the fifth embodiment and the sheet thickness detecting sensor 328 is a sensor having the same configuration with the second double-feeding detecting sensor of the fifth embodiment. In the present embodiment, the sheet movement detecting sensor 327 and the sheet thickness detecting sensor 328 correspond to double-feeding detecting portions.

Figure 28:
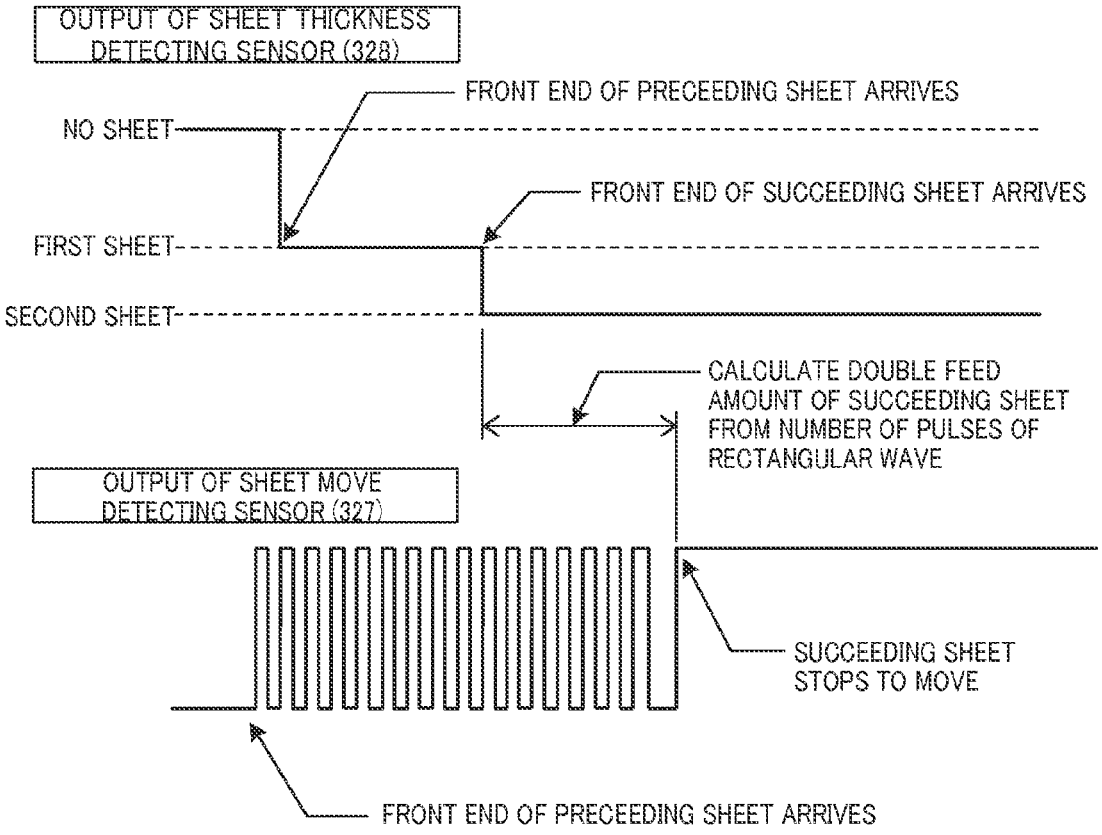
FIG. 28 illustrates output waveforms of the first and second double-feeding detecting sensors provided in the image forming apparatus.

FIG. 28 shows output waveforms of the sheet movement detecting sensor 327 and the sheet thickness detecting sensor 328 when a succeeding sheet is entrained by a preceding sheet being fed. Because a driven roller 321 of the sheet movement detecting sensor 327 is rotated by the preceding sheet before when the succeeding sheet is entrained, the sheet movement detecting sensor 327 outputs continuous rectangular waves as shown in FIG. 28.

Still further, output values of the sheet thickness detecting sensor 328 change from a value of one sheet to a value of two sheets at timing when the front end of the succeeding sheet passes through. When the entrained succeeding sheet soon stops on a way of the sheet conveying path 315, the rectangular wave output of the sheet movement detecting sensor 327 also stops and the sheet movement detecting sensor 327 outputs a certain large signal as a stop signal indicating that the succeeding sheet has stopped. Based on this stop signal, the control portion 500 counts a number of pulses of the rectangular waves outputted by the sheet movement detecting sensor 327 after when the sheet thickness detecting sensor 328 has detected the front end of the succeeding sheet. Then, based on the counted number, the control portion 500 calculates a distance from the sheet thickness detecting sensor 328 to the front end of the stopped succeeding sheet.

Figure 29:
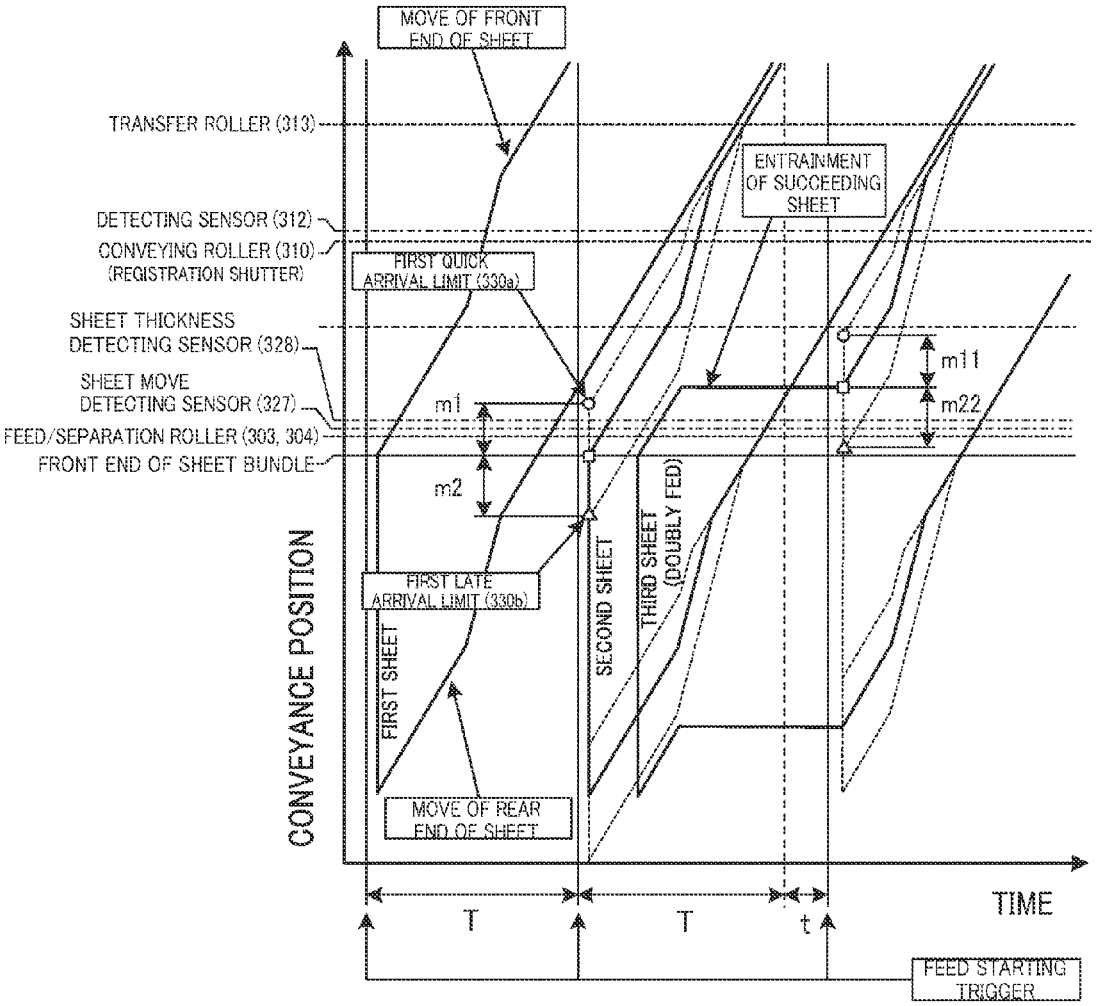
FIG. 29 is a timing chart illustrating sheet feeding and conveying controls of the image forming apparatus.

It is possible to calculate how far the succeeding sheet has been entrained from a control nominal position, i.e., a front end position in a state in which the sheet is stacked and stored in the sheet feeding cassette 305 or the entrained distance of the succeeding sheet from the result of this calculation. Then, the delay time t is determined from the calculation of the detected entrained distance and the sheet conveying speed (entrained distance/sheet conveying speed) and the feed starting timing of a next sheet is delayed by the delay time t. It is noted that in FIGS. 29, m1 and m2 denote the first quick arrival limit and the first late arrival limit, and a second quick arrival limit and a second late arrival limit are what are shifted downstream in the conveying direction with respect to m1 and m2 by t x conveying speed and are indicated by positions m11 and m21.

As described above, the present embodiment is arranged to detect the entrained distance of the succeeding sheet and to delay the feed starting timing of a next sheet by the delay time t based on the detected entrained distance. This arrangement makes it possible to select an optimum sheet feed starting timing corresponding to the entrained amount of the succeeding sheet, so that the margin for the quick arrival limit and the late arrival limit can be kept constant without relying on the entrainment state.

It is noted that while the several exemplary double-feeding detecting sensor have been disclosed in the above-mentioned description, any type of sensor may be used as long as the sensor can detect that the succeeding sheet has been entrained while overlapping with the preceding sheet being fed. It is possible to use a sensor configured to irradiate ultrasonic from one side of a sheet surface and to detect a double feeding state from attenuation characteristics of a waveform reaching to an opposite side or a sensor detecting the double feeding state by measuring electrical resistance in a sheet thickness direction.

Still further, while the most upstream double-feeding detecting sensor has been disposed between the separating portion and the conveying roller downstream thereof in the above description, the position where the double-feeding detecting sensor is disposed is not always necessary to be downstream of the separating portion. For instance, the most upstream double-feeding detecting sensor may be provided in a section between a front end position of a sheet bundle stacked and stored in the sheet feeding cassette to the separating portion in a sheet feeding apparatus having less margin of quick arrival limit. Still further, while the configuration in which a group of the rollers from the sheet feeding portion to the registration portion is driven by the same and one motor, this is an example of a configuration of an apparatus whose degree of freedom in terms of conveyance control is most limited and merely shows the advantageous effects of the present invention. Accordingly, it is possible to obtain the effect of enlarging the jam margin by the present invention even if the drive of the group of rollers disposed in the section from the sheet feeding portion to the transfer portion is divided in any manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-035789, filed Feb. 26, 2014 and Japanese Patent Application No. 2014-035790, filed Feb. 26, 2014 which are hereby incorporated by reference herein in their entirety.

What is claimed is:

1. A sheet feeding apparatus comprising:

a stacking portion;

a feeding portion configured to feed a sheet stacked in the stacking portion;

a moving amount detecting portion provided downstream of the feeding portion and configured to detect a moving amount of the sheet in a feeding direction in which the feeding portion feeds the sheet; and a control portion configured to, in a case where the moving amount, detected by the moving amount detecting portion while the feeding portion feeds a first sheet stacked in the stacking portion, is within a range corresponding to a length of the sheet in the feeding direction, control the feeding portion to start feeding a second sheet stacked in the stacking portion at a timing when a first time has passed since the feeding portion has started feeding the first sheet, and in a case where the moving amount is outside the range and is shorter than the length of the sheet in the feeding direction, control the feeding portion to start feeding the second sheet at a timing when a second time longer than the first time has passed since the feeding portion has started feeding the first sheet.

2. The sheet feeding apparatus according to claim 1, further comprising a conveying portion provided downstream of the moving amount detecting portion and configured to convey the sheet fed from the feeding portion, wherein in a case where the moving amount is outside the range, is shorter than the length of the sheet in the feeding direction and is longer than a distance between the moving amount detecting portion and the conveying portion along a sheet conveying path, the control unit controls the feeding portion to start feeding the second sheet at the timing when the second time has passed since the feeding portion started feeding the first sheet, and in a case where the moving amount is outside the range, is shorter than the length of the sheet and is shorter than the distance between the moving amount detecting portion and the conveying portion, the control unit controls the feeding portion to start feeding the second sheet at a timing when a third time which is longer than the first time and is shorter than the second time has passed since the feeding portion has started feeding the first sheet.

3. The sheet feeding apparatus according to claim 2, wherein the second time is a fixed time.

4. The sheet feeding apparatus according to claim 3, wherein the second time is the fixed time set based on the distance between the moving amount detecting portion and the conveying portion along the sheet conveying path.

5. The sheet feeding apparatus according to claim 2, wherein a curvature of the sheet conveying path from the moving amount detecting portion to the conveying portion is larger than a curvature of the sheet conveying path from the feeding portion to the moving amount detecting portion.

6. The sheet feeding apparatus according to claim 2, wherein in the case where the moving amount is outside the range, is shorter than the length of the sheet and is shorter than the distance between the moving amount detecting portion and the conveying portion, the control portion controls such that the longer the moving amount, the longer the third time is set.

7. The sheet feeding apparatus according to claim 1, wherein the moving amount detecting portion is provided to come in contact with a surface of the sheet on a side opposite from a surface with which the feeding portion comes in contact in feeding the sheet.

8. The sheet feeding apparatus according to claim 7, further comprising an opposing-side moving amount detecting portion provided downstream of the feed portion to be in contact with the surface of the sheet with which the feed portion comes in contact in feeding the sheet and configured to detect a moving amount of the sheet in the feed direction in which the sheet is fed by the feed portion.

9. The sheet feeding apparatus according to claim 7, further comprising an opposing-side moving amount detecting portion provided downstream of the feeding portion to be in contact with the surface of the sheet with which the feeding portion comes in contact in feeding the sheet and configured to detect a moving amount of the sheet in the feeding direction.

10. The sheet feeding apparatus according to claim 1, wherein the moving amount detecting portion includes a rotating body configured to rotate by being in contact with the sheet and a rotation amount detecting portion configured to detect a rotation amount of the rotating body.

11. The sheet feeding apparatus according to claim 1, wherein the moving amount detecting portion includes:

a light emitting portion;

an optical portion guiding a light emitted by the light emitting portion to a surface of the sheet;

an image sensor receiving a reflected light from the surface of the sheet irradiated by the light emitting portion and the optical portion; and a memory storing a received image.

12. The sheet feeding apparatus according to claim 1, further comprising a presence detecting portion provided downstream of the moving amount detecting portion and configured to detect whether or not the sheet is present.

13. The sheet feeding apparatus according to claim 1, further comprising a separating portion provided between the feeding portion and the moving amount detecting portion and configured to separate the sheet one by one by at a separation nip, wherein the separating portion includes a first roller and a second roller which form the separation nip.

14. The sheet feeding apparatus according to claim 1, wherein the moving amount detecting portion includes: a light emitting portion;

an optical portion guiding a light emitted by the light emitting portion to a surface of the sheet;

an image sensor receiving a reflected light from the surface of the sheet irradiated by the light emitting portion and the optical portion; and a memory storing a received image.

15. The sheet feeding apparatus according to claim 1, further comprising a presence detecting portion provided downstream of the moving amount detecting portion and configured to detect whether or not the sheet is present.

16. An image forming apparatus comprising:

a stacking portion;

a feeding portion configured to feed a sheet stacked in the stacking portion;

a moving amount detecting portion provided downstream of the feeding portion and configured to detect a moving amount of the sheet in a feeding direction in which the feeding portion feeds the sheet;

an image forming portion configured to form an image on a sheet; and a control portion configured to, in a case where the moving amount, detected by the moving amount detecting portion while the feeding portion feeds a first sheet stacked in the stacking portion, is within a range corresponding to a length of the sheet in the feeding direction, control the feeding portion to start feeding a second sheet stacked in the stacking portion at a timing when a first time has passed since the feeding portion has started feeding the first sheet, and in a case where the moving amount is outside the range and is shorter than the length of the sheet in the feeding direction, control the feeding portion to start feeding the second sheet at a timing when a second time longer than the first time has passed since the feeding portion has started feeding the first sheet.

17. The image forming apparatus according to claim 16, further comprising a conveying portion provided downstream of the moving amount detecting portion and configured to convey the sheet fed from the feeding portion, wherein in a case where the moving amount is outside the range, is shorter than the length of the sheet in the feeding direction and is longer than a distance between the moving amount detecting portion and the conveying portion along a sheet conveying path, the control unit controls the feeding portion to start feeding the second sheet at the timing when the second time has passed since the feeding portion has started feeding the first sheet, and in a case where the moving amount is outside the range, is shorter than the length of the sheet in the feeding direction and is shorter than the distance between the moving amount detecting portion and the conveying portion, the control unit controls the feeding portion to start feeding the second sheet at a timing when a third time which is longer than the first time and is shorter than the second time has passed since the feeding portion has started feeding the first sheet.

18. The image forming apparatus according to claim 17, wherein the second time is a fixed time.

19. The image forming apparatus according to claim 18, wherein the second time is the fixed time set based on the distance between the moving amount detecting portion and the conveying portion along the sheet conveying path.

20. The image forming apparatus according to claim 17, wherein in the case where the moving amount is beyond the range, is shorter than the length of the sheet and is shorter than the distance between the moving amount detecting portion and the conveying portion, the control portion controls such that the longer the moving amount, the longer the third time is set.

21. The image forming apparatus according to claim 17, wherein a curvature of the sheet conveying path from the moving amount detecting portion to the conveying portion is larger than a curvature of the sheet conveying path from the feeding portion to the moving amount detecting portion.

22. The image forming apparatus according to claim 16, wherein the moving amount detecting portion is provided to come in contact with a surface of the sheet on a side opposite from a surface with which the feeding portion comes in contact in feeding the sheet.

23. The image forming apparatus according to claim 22, further comprising an opposing-side moving amount detecting portion provided downstream of the feeding portion to be in contact with the surface of the sheet with which the feeding portion comes in contact in feeding the sheet and configured to detect a moving amount of the sheet in the feeding direction.

24. The image forming apparatus according to claim 16, wherein the moving amount detecting portion includes a rotating body configured to rotate by being in contact with the sheet and a rotation amount detecting portion configured to detect a rotation amount of the rotating body.

25. The image forming apparatus according to claim 16, wherein the moving amount detecting portion includes:

a light emitting portion;

an optical portion guiding a light emitted by the light emitting portion to a surface of the sheet;

an image sensor receiving a reflected light from the surface of the sheet irradiated by the light emitting portion and the optical portion; and a memory storing a received image.

26. The image forming apparatus according to claim 16, further comprising a presence detecting portion provided downstream of the moving amount detecting portion and configured to detect whether or not the sheet is present.

27. The image forming apparatus according to claim 16, further comprising a separating portion provided between the feeding portion and the moving amount detecting portion and configured to separate the sheet one by one by at a separation nip wherein the separating portion includes a first roller and a second roller which form the separation nip.

* * * * *